US006684042B2

(12) United States Patent
Nagamori et al.

(10) Patent No.: US 6,684,042 B2
(45) Date of Patent: Jan. 27, 2004

(54) CHARGING DEVICE AND IMAGE FORMING APPARATUS USING THE SAME

(75) Inventors: Yuki Nagamori, Ebina (JP); Yutaka Kanai, Ebina (JP); Yasuo Takayama, Ebina (JP); Yasutomo Ishii, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/097,357

(22) Filed: Mar. 15, 2002

(65) Prior Publication Data

US 2003/0095812 A1 May 22, 2003

(30) Foreign Application Priority Data

Nov. 20, 2001 (JP) ..... 2001-355126

(51) Int. Cl.[7] ..... G03G 15/02

(52) U.S. Cl. ..... 399/176; 361/221; 399/149; 399/313; 492/49; 492/56

(58) Field of Search ..... 399/176, 174, 399/279, 286, 313, 148, 149; 361/221, 225; 492/18, 49, 53, 56

(56) References Cited

U.S. PATENT DOCUMENTS 5,534,344 A * 7/1996 Kisu et al. ..... 361/221 X
5,701,570 A * 12/1997 Takuma ..... 399/149 X
6,205,310 B1 * 3/2001 Onishi ..... 399/176
6,293,895 B1 * 9/2001 Koyama et al. ..... 492/56
6,341,207 B1 * 1/2002 Sasaki et al. ..... 399/149
6,374,071 B1 * 4/2002 Sato ..... 399/174
6,438,331 B2 * 8/2002 Sakaizawa et al. ..... 399/149 X

FOREIGN PATENT DOCUMENTS

| | | | |
|---|---|---|---|
| JP | A 6-175465 | | 6/1994 |
| JP | A 8-36288 | | 2/1996 |
| JP | A 8-44142 | | 2/1996 |
| JP | A 8-62920 | | 3/1996 |
| JP | A 8-160839 | | 6/1996 |
| JP | A 9-325560 | | 12/1997 |
| JP | A 10-186800 | | 7/1998 |
| JP | A 11-125956 | | 5/1999 |
| JP | 2002-049217 | * | 2/2002 |

* cited by examiner

*Primary Examiner*—Sophia S. Chen
(74) *Attorney, Agent, or Firm*—Oliff & Berridge PLC

(57) ABSTRACT

In order to solve the problem, there is provided a charging device having: a roll-like charging member disposed in contact with a surface of a member to be charged and for charging the surface of the member to be charged; wherein: the charging member includes a conductive substrate, and at least an elastic layer and a surface layer applied sequentially onto a surface of the conductive substrate; and opposite end portions of the surface layer axially project beyond opposite end portions of the elastic layer respectively, while the opposite end portions of the surface layer are made to cover the elastic layer and made open.

25 Claims, 11 Drawing Sheets

FIG.9
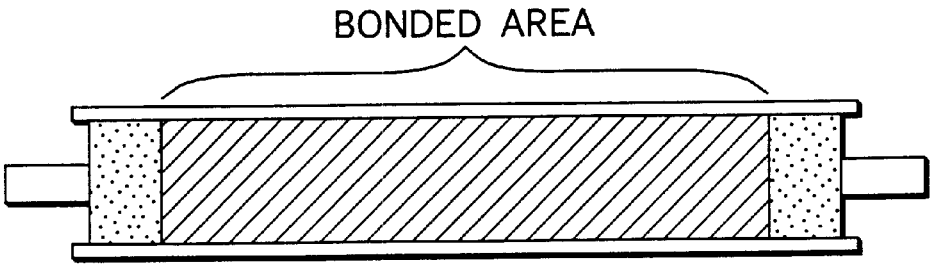
FIG.10
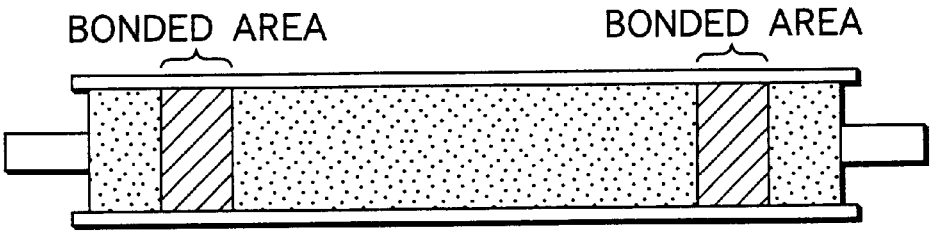
FIG.11
| MD1 HARDNESS<br>DEFECT | 88 | 72 | 66 | 42 |
|---|---|---|---|---|
| SPOT | ×× | × | ○ | ○○ |
| FILMING | ×× | × | ○ | ○○ |
| DELETION | × | × | ○ | ○○ |

FIG.15
| CHARGER MATERIAL | IP VALUE (eV) | ADHERING TONER | RESIDUAL TONER | INITIAL IMAGE QUALITY | STAINED IMAGE QUALITY |
|---|---|---|---|---|---|
| PVdF | 4.72 | 0.445 | 0.072 | 1 | 4 |
| PVdF+E | 4.75 | 0.301 | 0.294 | 3 | 4 |
| ETFE | 4.83 | 0.149 | 0.025 | 1 | 1 |
| PEE | 4.69 | 0.51 | 0.143 | 2 | 3 |
| ECO | 4.49 | 2.082 | 2.23 | 3 | 3 |
| ECO+PHT | 4.54 | 0.744 | 0.104 | 1 | 3 |
| ECO+96SP | 4.7 | 3.031 | 2.903 | 2 | 4 |
| ECO+SC | 4.8 | 0.259 | 0.038 | 1 | 1 |
FIG.16
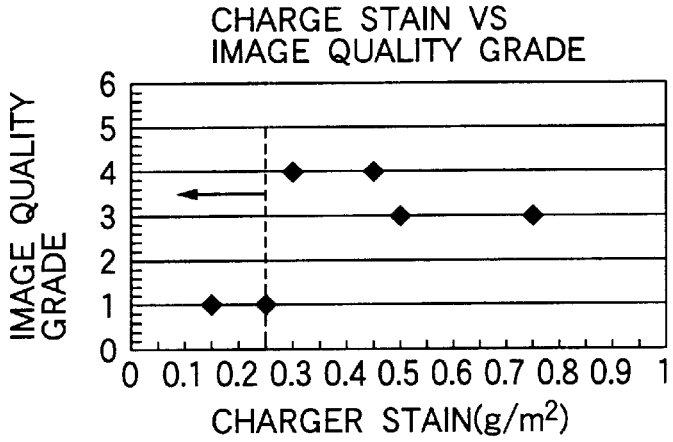
FIG.17
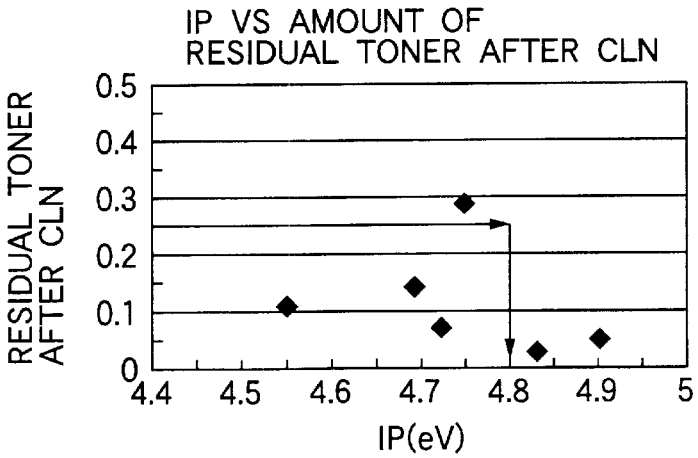

CHARGING DEVICE AND IMAGE FORMING APPARATUS USING THE SAME

BACKGROUND OF THE INVENTION

1. Field of the Invention

The present invention relates to a charging device for use in an image forming apparatus such as a printer, a copying machine or a facsimile machine adopting an electrophotographic system, and an image forming apparatus using the charging device. Particularly, the invention relates to a contact type charging device which comes in contact with the surface of a member to be charged so as to charge the surface of the member to be charged, and an image forming apparatus using the charging device.

2. Description of the Related Art

Of a related-art image forming apparatus of this type such as a printer, a copying machines or a facsimile machine adopting an electrophotographic system, as an apparatus that can form color images at high speed and with high image quality, various so-called full-color tandem machines have been proposed and manufactured practically. In such a tandem machine, four image forming units for forming toner images of respective colors of yellow, magenta, cyan, and black are disposed horizontally in parallel with one another. The toner images of the respective colors of yellow, magenta, cyan and black formed sequentially on the respective image forming units are once primary-transferred in multi-layers onto an intermediate transfer belt. After that, the multi-layer toner images are secondary-transferred from the intermediate transfer belt onto recording paper in a lump, and fixed onto the recording paper. Thus, a color image is formed.

However, in such a full-color tandem machine, four image forming units for forming toner images of respective colors of yellow, magenta, cyan, and black have to be disposed horizontally in parallel with one another, and an intermediate transfer belt has to be disposed under these four image forming units. It is therefore difficult to miniaturize the machine as it is, and the machine is not suitable to be produced as a desktop type printer.

Accordingly, various techniques for making it possible to miniaturize such full-color tandem machines while utilizing the feature that color images can be formed at high speed and with high image quality, that is, various techniques about so-called micro-tandem machines have been proposed, for example, as disclosed in JP-A-Hei.8-36288, JP-A-Hei.8-62920, JP-A-Hei.8-160839, and JP-A-Hei.9-325560 (corresponding to Japanese Patent Application No.Hei.8-166705).

According to such a technique about a micro-tandem machine, four image forming units of yellow, magenta, cyan, and black are disposed vertically, while recording paper is conveyed vertically by a paper conveying belt or directly. Thus, the installation area can be reduced. Further, the four image forming units themselves and photoconductor drums are reduced in diameter for realizing miniaturization so that the machine as a whole can be miniaturized.

When the diameter of each photoconductor drum is reduced thus to miniaturize the full-color tandem machine, it is necessary to reduce the diameter of each charging roll that comes in contact with the surface of the corresponding photoconductor drum so as to charge the surface of the corresponding photoconductor drum. Further, when the diameter of the photoconductor drum is reduced, a blade-like cleaning unit for removing foreign matters such as toner adhering to the surface of the photoconductor drum may be difficult to displace around the photoconductor drum. Because the photoconductor drum has a small diameter, there is also a problem that the abrasion of the drum caused by the friction with the blade becomes so conspicuous that the life of the drum is shortened. In this case, it is inevitable to adopt a cleanerless system using no blade cleaning unit or having a pseudo cleaning unit.

As the charging roll, a roll in which the outer circumference of a metal shaft is coated with a conductive rubber layer with adjusted resistivity is generally used. However, when the diameter of the charging roller is reduced, the hardness of the rubber layer is so high that the contact pressure becomes lower in the center portion than that in the opposite end portions. Thus, there is a problem that it becomes difficult to bring the charging roll into contact with the surface of the photoconductor drum uniformly in the axial direction so that charging becomes ununiform.

Therefore, in order to solve the foregoing problem and to bring the charging roll reduced in diameter into contact with the surface of the photoconductor drum uniformly, it can be considered that the outer shape of the charging roll is formed into a crown shape, or a large amount of plasticizer is added to the rubber layer so as to make the hardness lower.

In this case, however, it is necessary to work the outer shape of the charging roll into a crown shape with precision. Thus, the lowering of the yield results in increase in the cost. On the other hand, when a large amount of plasticizer is added, there arises a new problem that the plasticizer exudes to cause a trouble called "bleed" in which the plasticizer bleeds to have a damaging effect on charging.

Therefore, techniques for solving the foregoing problems while making uniform charging possible even if the diameter of a charging roller is reduced have been proposed, for example, as disclosed in JP-A-Hei.6-175465, JP-A-Hei.8-44142, JP-A-Hei.10-186800, and JP-A-Hei.11-125956.

The contact type charging device according to JP-A-Hei.6-175465 is configured as follows. That is, a metal core supported rotatably is disposed in a flexible tube having at least a conductive layer and a resistive layer outside the conductive layer. The tube is supported from the inside by the conductive flexible layer provided around the metal core. A power supply for applying a charging voltage to the tube to thereby charge a member to be charged in contact with the tube is connected to the metal core. The conductive layer is made shorter than the resistive layer in the same direction as the longitudinal direction of the tube.

On the other hand, the charging device according to JP-A-Hei.8-44142 is a charging device for use in an electrophotographic system as follows. That is, the charging device is constituted by a charging roller having a flexible conductive flexible sheet on the surface. The conductive flexible sheet is a laminate sheet of a low electric resistive layer as an inner layer and a high electric resistive layer as an outer layer. The surface resistivity of the high electric resistive layer is not lower than $10^6$ Ω/□ but lower than $10^7$ Ω/□, while the volume resistivity of the low electric resistive layer is not higher than $10^5$ Ω·cm.

Further, the conductive roller according to JP-A-Hei.10-186800 is a conductive roller constituted by a plurality of layers laminated on one another. The conductive roller is arranged as follows. That is, at least a first layer and a second layer are provided as the laminated layers. The second layer is disposed adjacently to the outer circumferential side of the first layer, and the resistance of the second layer is higher than that of the first layer. The first layer is designed so that the outer circumferential portion of each end surface thereof makes an acute angle with the second layer.

Furthermore, the charging member according to JP-A-Hei.11-125956 is a charging member constituted by a conductive foam material and a conductive resin material applied onto the conductive foam material and for coming in contact with a member to be charged so as to charge the member to be charged. The charging member is arranged as follows. That is, the electric resistance of the conductive foam material is not higher than $9\times10^5$ Ω. The conductive resin material is made conductive by a conductive material so that the surface electric resistance of the conductive resin material is not lower than $1\times10^5$ Ω/□ and not higher than $9\times10^7$ Ω/□. In addition, the product hardness as a conductive member is not higher than 90° in Asker F.

However, the related art has problems as follows. That is, any charging device disclosed in JP-A-Hei.6-175465, JP-A-Hei.8-44142, JP-A-Hei.10-186800, and JP-Hei.11-125956 can be indeed applied to a general charging roll whose diameter is about 12 mm or 14 mm. But it is difficult to make the diameter of the charging roll smaller than that. Particularly in a charging roll having a very small diameter not larger than 10 mm, there is a problem that leakage is produced between a shaft located in the vicinity of power feeding electrodes, and the surface of a photoconductor drum.

To solve such a problem, it can be considered that a charging roll 1000 from one end surface to the other end surface is covered with a surface layer 1001. In this case, as shown in FIG. 18, the surface layer 1001 projects beyond the end portions of the charging roll 1000. Thus, there occurs a failure in the outer shape, uneven contact between the charging roll and a photoconductor drum surface, or a change of the outer shape due to an environmental change, such as depression of the surface layer due to the shrinkage of the air confined in the surface layer in the charging roll end portions at the time of low temperature. In addition, because the charging roll from one end surface to the other end surface is covered with the surface layer, there is a new problem that the processing cost increases.

Further, any charging roll disclosed in the respective publications is required to come in uniform contact with the surface of the photoconductor drum. However, the smaller the diameter of the charging roll is made, the more difficult it is to keep the accuracy of the outer shape of sponge or a tube forming the elastic layer or the surface layer. When the charging roll rotates in contact with the surface of the photoconductor drum, the surface of the charging roll is deformed unevenly. Thus, there arises another problem that charging unevenness corresponding to the pitch of the roll is apt to appear as shown in FIG. 19.

Therefore, the invention was developed to solve the foregoing problems belonging to the related art. It is an object of the invention to provide a charging device which can prevent leakage from its end portions with a simple structure even if the diameter of a charging roll is made smaller, and which is superior in uniformity of charging, and to provide an image forming apparatus using the charging device.

SUMMARY OF THE INVENTION

In order to solve the problems, according to a first aspect of the invention, there is provided a charging device having a roll-like charging member disposed in contact with a surface of a member to be charged and for charging the surface of the member to be charged, wherein the charging member has:

a conductive substrate;

an elastic layer; and a surface layer, wherein the elastic layer and the surface layer are applied sequentially onto a surface of the conductive substrate;

wherein opposite end portions of the surface layer axially project beyond opposite end portions of the elastic layer, respectively; and wherein the opposite end portions of the surface layer cover the elastic layer and open.

According to a second aspect of the invention, there is provided the charging device according to the first aspect, wherein a relationship among an outer diameter of the conductive substrate in a nip portion of the charging member, a thickness of the elastic layer and a thickness of the surface layer satisfies:

the outer diameter of the conductive substrate in the nip portion of the charging member>the thickness of the elastic layer+the thickness of the surface layer.

According to the second aspect of the invention, the relationship among the outer diameter of the conductive substrate in the nip portion of the charging member, the thickness of the elastic layer and the thickness of the surface layer satisfies:

the outer diameter of the conductive substrate in the nip portion of the charging member>the thickness of the elastic layer+the thickness of the surface layer. Accordingly, the charging roll can be made smaller in diameter. At the same time, with the conductive substrate made smaller in diameter, the charging roll can be made lighter in weight.

In addition, according to the second aspect of the invention, when the opposite end portions of the surface layer are made open, urethane is usually used as the material for forming the elastic layer which is a layer under the surface layer. The urethane is apt to absorb moisture, and the elastic layer made of the urethane or the like is thinned so that the volume can be reduced. Thus, deformation can be prevented, and particularly deformation in the end portions can be prevented.

According to a third aspect of the invention, there is provided the charging device according to the first aspect, wherein each of projecting portions of the end portions of the surface layer is longer than the thickness of the surface layer.

When each of the projecting portions of the end portions of the surface layer is made longer than the thickness of the surface layer, an electric gradient is given to each of the end portions. Thus, leakage from the end portions can be prevented surely.

According to a fourth aspect of the invention, there is provided the charging device according to the first aspect, wherein the charging member has a higher resistance value in its opposite ends than that in a power feeding portion.

Also in this case, when the resistance value of the charging member is made higher in the opposite ends than that in the power feeding portion, an electric gradient is given to each of the end portions. Thus, leakage from the end portions can be prevented surely.

According to a fifth aspect of the invention, there is provided the charging device according to the first aspect, wherein the conductive substrate is set to have a larger outer diameter in a nip portion thereof than that in any other portion thereof.

When the outer diameter of the nip portion is set to be larger than any other portion in the conductive substrate, leakage from the end portions of the conductive substrate is apt to cause a problem. Therefore, the configuration as in any one of the first to fourth aspects becomes effective.

According to a sixth aspect of the invention, there is provided the charging device according to the first aspect, wherein the charging member is set to have a diameter not larger than 10 mm.

When the diameter of the charging member is set to be not larger than 10 mm, leakage from the end portions of the charging member is apt to cause a problem. Therefore, the configuration as in any one of the first to fourth aspects becomes effective.

Further, according to a seventh aspect of the invention, there is provided the charging device according any one of the first to sixth aspects, wherein the surface layer is formed to be longer than the elastic layer.

Further, according to an eighth aspect of the invention, there is provided the charging device according to any one of the first to seventh aspects, wherein the charging member has a ratio of a length of a charging portion to a diameter of the conductive substrate expressed by:

(length of charging portion)/(diameter of conductive substrate)$\geqq$40.

Further, according to a ninth aspect of the invention, there is provided the charging device according to any one of the first to eighth aspects, wherein the surface layer is bonded to a surface of the elastic layer; and wherein an unbonded area is partially provided in the surface layer in an axial direction of the charging member.

According to a tenth aspect of the invention, there is provided the charging device according to the ninth aspect, wherein the unbonded area is provided in opposite end portions of the surface layer in the axial direction of the charging member.

Further, according to an eleventh aspect of the invention, there is provided the charging device according any one of the first to tenth aspects, wherein a voltage applied to the charging member includes only a DC voltage.

Still further, according to a twelfth aspect of the invention, there is provided the charging device according to any one of the first to eleventh aspects, wherein the charging member has a peripheral velocity difference from that of the member to be charged.

Further, according to a thirteenth aspect of the invention, there is provided the charging device according to any one of the first to twelfth aspects, wherein the charging member does not have, on an upstream side thereof, any cleaning unit for removing foreign matters adhering to a surface of the member to be charged.

Further, according to a fourteenth aspect of the invention, there is provided the charging device according to any one of the first to thirteenth aspects, wherein the upstream side of the charging member is one of a transfer unit and a pseudo cleaning unit for temporarily retaining residual toner which failed in transfer.

Incidentally, as the pseudo cleaning unit, for example, there is used a refresher brush which scrapes foreign matters adhering to the surface of a member to be charged, so as to temporarily retain residual toner or the like which failed in transfer. This refresher brush does not permanently remove the residual toner or the like adhering to the surface of the member to be charged, but retains the residual toner or the like temporarily. For example, the refresher brush is used in the following system. That is, the residual toner which failed in transfer but is retained by adhesion to the charging member or the pseudo cleaning unit is transferred onto another member by the electric potential gradient among the charging member, the member to be charged, and so on. Finally, the transferred residual toner is removed permanently by a cleaning unit provided on the surface of the member to which the residual toner has been transferred.

Further, according to a fifteenth aspect of the invention, there is provided the charging device according to any one of the first to fourteenth aspects, wherein the surface layer is made of a thin tubular member.

Further, according to a sixteenth aspect of the invention, there is provided the charging device according to any one of the first to fifteenth aspects, wherein the elastic layer is made of urethane foam.

Further, according to a seventeenth aspect of the invention, there is provided the charging device according to any one of the first to sixteenth aspect, wherein the charging member is used for one of transfer and elimination of charge.

Further, according to an eighteenth aspect of the invention, there is provided the charging device according to the first to seventeenth aspects, wherein the charging member is set so that Asker MD1 hardness of a surface of the charging member is not higher than 70°.

Further, according to a nineteenth aspect of the invention, there is provided the charging device according to any one of the first to eighteenth aspects, wherein the charging member is set so that ionization potential of a surface of the charging member is not lower than 4.8 eV.

Still further, according to twentieth aspect of the invention, there is provided an image forming apparatus having:

an image carrying body; and a roll-like charging member brought in contact with a surface of the image carrying body, the charging member for charging the surface of the image carrying body to form a toner image on the image carrying body, wherein any cleaning unit for removing foreign matters adhering to a surface of a member to be charged is not provided on an upstream side of the charging member;

wherein the charging member has:

a conductive substrate;

an elastic layer; and a surface layer, wherein the elastic layer and the surface layer are applied sequentially onto a surface of the conductive substrate;

wherein opposite end portions of the surface layer axially project beyond opposite end portions of the elastic layer, respectively; and wherein the opposite end portions of the surface layer cover the elastic layer and open.

Still further, according to a twenty-first aspect of the invention, there is provided an image forming apparatus having:

an image carrying body; and a roll-like charging member brought in contact with a surface of the image carrying body, the charging member for charging the surface of the image carrying body to form a toner image on the image carrying body, wherein one of a transfer unit and a pseudo cleaning unit for temporarily retaining residual toner which failed in transfer is disposed in an upstream side of the charging member;

wherein the charging member has:

a conductive substrate;

an elastic layer; and a surface layer, wherein the elastic layer and the surface layer are applied sequentially onto a surface of the conductive substrate;

wherein opposite end portions of the surface layer axially project beyond opposite end portions of the elastic layer, respectively; and wherein the opposite end portions of the surface layer cover the elastic layer and open.

Further, according to a twenty-second aspect of the invention, there is provided the image forming apparatus according to any one of twentieth or twenty-first aspect, wherein a relationship among an outer diameter of the conductive substrate in a nip portion of the charging member, a thickness of the elastic layer and a thickness of the surface layer satisfies:

the outer diameter of the conductive substrate in the nip portion of the charging member>the thickness of the elastic layer+the thickness of the surface layer;

wherein at least the charging member and the image carrying body are integrated into one unit; and wherein the unit is removably attached to a body of the image forming apparatus.

BRIEF DESCRIPTION OF THE DRAWINGS

FIG. 9 is an explanatory view showing a bonded area of the charging roll.

FIG. 10 is an explanatory view showing bonded areas of the charging roll.

FIG. 11 is a table showing the result of an experiment.

FIG. 15 is a table showing the result of an experiment.

FIG. 16 is a graph showing the result of the experiment.

FIG. 17 is a graph showing the result of the experiment.

DETAILED DESCRIPTION OF THE PREFERRED EMBODIMENTS

Embodiments of the invention will be described below with reference to the drawings.

Embodiment 1

Figure 2:
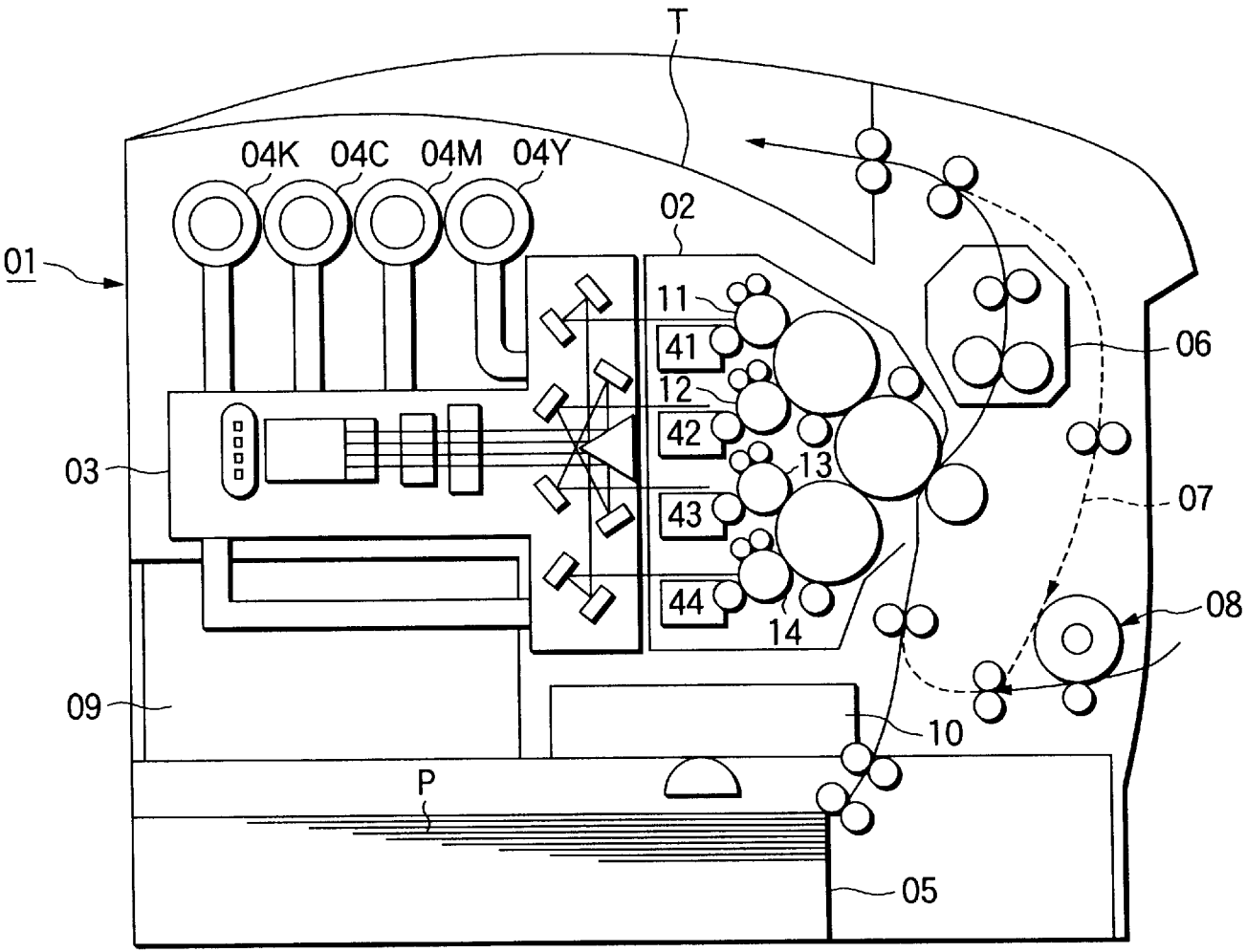
FIG. 2 is a configuration view showing a tandem type full-color printer as an image forming apparatus to which charging devices according to Embodiment 1 of the invention have been applied.

FIG. 2 shows a tandem type full-color printer as an image forming apparatus to which charging devices according to Embodiment 1 of the invention have been applied.

In FIG. 2, reference numeral 01 denotes a body of the tandem type full-color printer. Generally, in the printer body 01, there are provided a print head device 02 for forming a full-color image; an ROS (Raster Output Scanner) 03 as an exposure unit for giving image exposure to four photoconductor drums 11, 12, 13 and 14 functioning as image carrying bodys of this print head device 02; four toner cartridges 04Y, 04M, 04C and 04K for supplying toner of respective colors to corresponding color developing units 41, 42, 43 and 44 of the print head device 02; a paper feeding cassette 05 for feeding recording paper P as a recording medium to the print head device 02; a fixing unit 06 for carrying out a fixing treatment on the paper P to which a toner image has been transferred from the print head device 02; a double-sided-print conveying path 07 for conveying the paper P to a transfer portion of the print head device 02 again while one side of the paper P has an image fixed by the fixing unit 06 and the paper P has been turned over; a manual paper feeding unit 08 for feeding desired paper P from the outside of the printer body 01; a controller 09 for controlling the operation of the printer; and an electric circuit 10 constituted by an image processing circuit for carrying out image processing on image signals, a high voltage power supply circuit, and so on. Incidentally, in FIG. 2, the symbol T designates a discharge tray for discharging the paper P on which an image has been formed. This discharge tray T is disposed integrally with the upper portion of the printer body 01.

Of the various members disposed in the inside of the printer body 01, the ROS 03 as an exposure unit is made of four semiconductor lasers, a f-θ lens, a polygon mirror, and a plurality of reflecting mirrors. The semiconductor lasers are driven and lit on the basis of image data corresponding to the respective colors of yellow (Y), magenta (M), cyan (C) and black (K). Four laser beams emitted from the four semiconductor lasers are scanned and deflected by the f-θ lens, the polygon mirror, and the reflecting mirrors.

Figure 3:
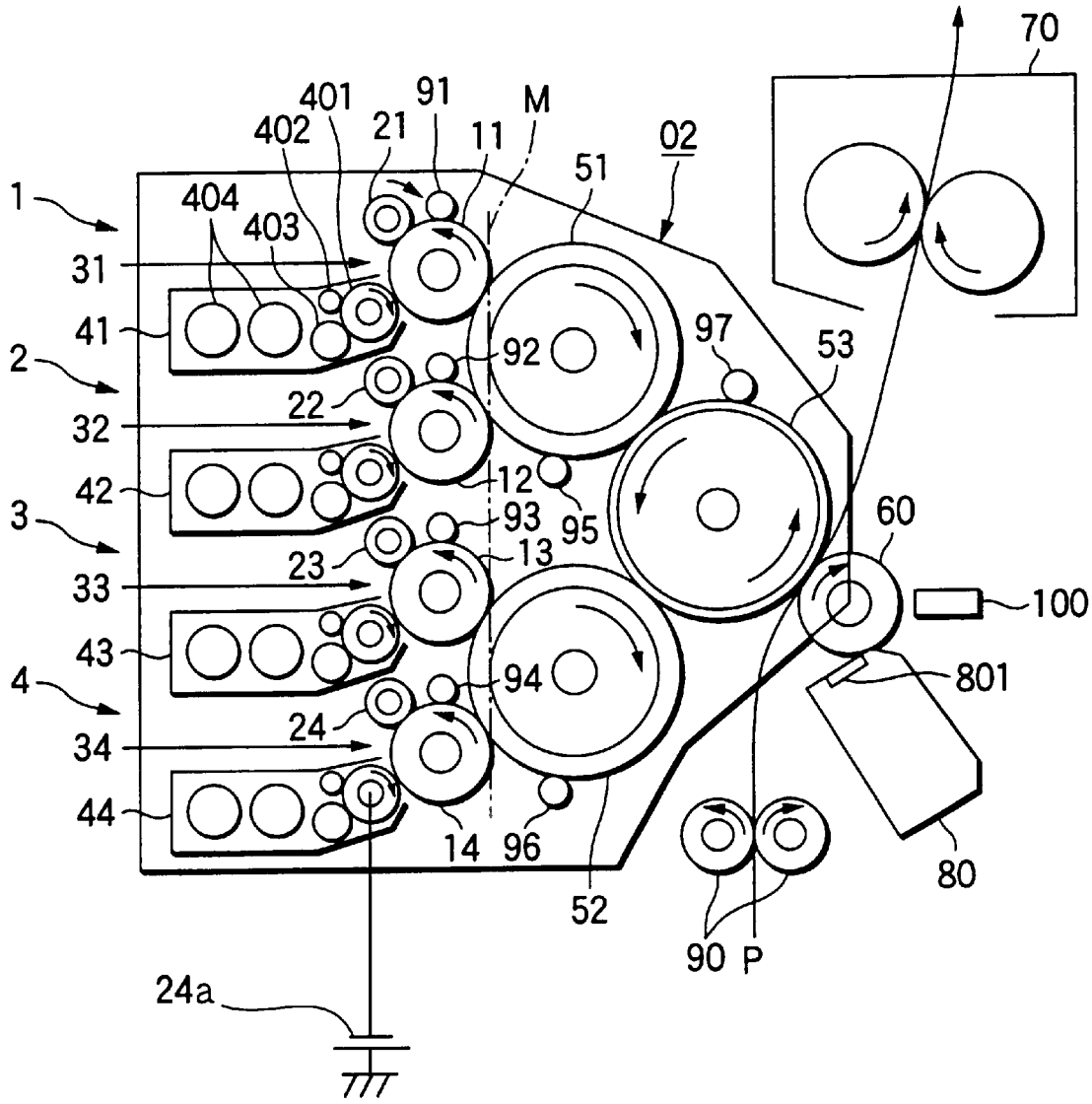
FIG. 3 is a configuration view showing a print head.

FIG. 3 shows the print head device of the tandem type full-color printer as the image forming apparatus according to Embodiment 1 of the invention. Incidentally, the arrows in FIG. 3 designate rotating directions of respective rotating members.

As shown in FIG. 3, the main portion of this print head device 02 is constituted by the image forming units 1, 2, 3 and 4 having the photoconductor drums (image carrying bodys) 11, 12, 13 and 14 for yellow (Y), magenta (M), cyan (C) and black (K) respectively; charging rolls (contact type charging devices) 21, 22, 23 and 24 for primary charging in contact with the photoconductor drums 11, 12, 13 and 14 respectively; the ROS (exposure unit) 03 (see FIG. 2) for irradiating the photoconductor drums 11, 12, 13 and 14 with laser beams 31, 32, 33 and 34 of the colors of yellow (Y), magenta (M), cyan (C) and black (K) respectively; the developing units 41, 42, 43 and 44 for developing electrostatic latent images formed on the photoconductor drums 11, 12, 13 and 14 with toners of the colors of yellow (Y), magenta (M), cyan (C) and black (K) respectively; a first primary intermediate transfer drum (intermediate transferor) 51 in contact with the two photoconductor drums 11 and 12 of the four photoconductor drums 11, 12, 13 and 14; a second primary intermediate transfer drum (intermediate transferor) 52 in contact with the other two photoconductor drums 13 and 14; a secondary intermediate transfer drum (intermediate transferor) 53 in contact with the first and second primary intermediate transfer drums 51 and 52; and a final transfer roll (transfer member) 60 in contact with the secondary intermediate transfer drum 53.

The photoconductor drums 11, 12, 13 and 14 are disposed at predetermined intervals so as to have a common tangent plane M. In addition, the first and second primary intermediate transfer drums 51 and 52 are disposed so that the rotation axes thereof are parallel to the axes of the photoconductor drums 11, 12, 13 and 14 and in a relationship of plane symmetry thereto with respect to a predetermined plane of symmetry. Further, the secondary intermediate transfer drum 53 is disposed so that the rotation axis thereof is parallel to the rotation axes of the photoconductor drums 11, 12, 13 and 14.

Signals corresponding to image information for every color are rasterized by an image processing circuit disposed in the electric circuit 10 (see FIG. 2), and supplied to the ROS 03. In this ROS 03, the laser beams 31, 32, 33 and 34 of the respective colors of yellow (Y), magenta (M), cyan (C) and black (K) are modulated, and the corresponding color photoconductor drums 11, 12, 13 and 14 are irradiated with the laser beams 31, 32, 33 and 34.

Around the photoconductor drums 11, 12, 13 and 14, an image forming process based on a known electrophotographic system is executed for every color. First, for example, a photoconductor drum using an OPC photoconductor of a diameter of 20 mm is used as each of the photoconductor drums 11, 12, 13 and 14. These photoconductor drums 11, 12, 13 and 14 are driven to rotate, for example, at a rotational velocity of 95 mm/sec. As shown in FIG. 3, for example at 24*a*, a DC voltage of about −900 V is applied to the charging rolls 21, 22, 23 and 24 as contact type charging devices, so that the surfaces of the photoconductor drums 11, 12, 13 and 14 are charged to, for example, about −300 V, as will be described in detail later. In addition, although a charging system for applying only DC is adopted to charge the surfaces of the photoconductor drums 11, 12, 13 and 14 in this embodiment, a charging system for applying AC and DC may be used.

After that, the surfaces of the photoconductor drums 11, 12, 13 and 14 are irradiated with the laser beams 31, 32, 33 and 34 corresponding to the respective colors of yellow (Y), magenta (M), cyan (C) and black (K) by the ROS 03 functioning as an exposure unit. Thus, electrostatic latent images corresponding to input image information of the respective colors are formed. When the electrostatic latent images are written in the photoconductor drums 11, 12, 13 and 14 by the ROS 03, the surface potentials of the image exposure portions of the photoconductor drums 11, 12, 13 and 14 are destaticized to, for example, about −60 V or less.

In addition, the electrostatic latent images corresponding to the respective colors of yellow (Y), magenta (M), cyan (C) and black (K) formed in the surfaces of the photoconductor drums 11, 12, 13 and 14 are developed by the corresponding color developing units 41, 42, 43 and 44 respectively. Thus, the electrostatic latent images are visualized as toner images of the respective colors of yellow (Y), magenta (M), cyan (C) and black (K) on the respective photoconductor drums 11, 12, 13 and 14.

Although a magnetic brush contact type two-component development system is adopted for the developing units 41, 42, 43 and 44 in this embodiment, the scope of application of the invention is not limited to such a development system. Not to say, the invention is satisfactorily applicable also to other development systems such as a non-contact type development system or a one-component development system.

The developing units 41, 42, 43 and 44 are filled with developers composed of different color toners of yellow (Y), magenta (M), cyan (C) and black (K), and carriers, respectively. As shown in FIG. 2, when toner is supplied from the color toner cartridges 04Y, 04M, 04C and 04K to the corresponding developing units 41, 42, 43 and 44, the supplied toner is stirred with the carriers sufficiently by augers 404 so as to be tribo-charged. In the inside of each of developing rolls 401, a magnet roll (not shown) in which a plurality of magnetic poles are disposed at predetermined angles is fixedly disposed. The developer conveyed to the vicinity of the surface of the developing roll 401 by a corresponding paddle 403 for conveying the developer to the developing roll 401 is regulated in quantity to be conveyed to the developing portion by a corresponding developer quantity regulating member 402. In this embodiment, the quantity of the developer is in a range of from 30 g/m$^2$ to 50 g/m$^2$. In addition, the charging quantity of the toner existing on the developing roll 401 at this time is approximately in a range of from −20 $\mu$C/g to 35 $\mu$C/g.

The toner supplied onto the developing roll 401 is shaped like a magnetic brush constituted by the carriers and the toner by the magnetic force of the magnet roll. This magnetic brush abuts against the photoconductor drum 11, 12, 13 and 14. An AC and DC development bias voltage is applied to the developing roll 401 so that the toner on the developing roll 401 is developed on the electrostatic latent image formed on the photoconductor drum 11, 12, 13 and 14. Thus, a toner image is formed. In this embodiment, the AC component of the development bias voltage is set to have 4 kHz and 1.5 kVpp, and the DC component thereof is set to about −230 V.

In this embodiment, so-called "spherical toner" which is substantially spherical and whose average particle size is about 3–10 $\mu$m is used as the toner in the developing units 41, 42, 43 and 44. For example, the average particle size of black toner is set to 8 $\mu$m, and the average particle size of color toner is set to 7 $\mu$m.

The spherical toner is, for example, manufactured by agglutination growth using a dispersion polymerization method. As for the manufacturing process, spherical toner is refined through the step of mixing a fluid dispersion of styrene/acrylic particles, a fluid dispersion of coloring material particles and a fluid dispersion of wax particles, the step of agglutinating the particles, the step of heating and conglutinating the agglutinated particles, and the step of cleansing. By controlling the temperature, the agglutination time, the dispersion density, and so on, in the step of agglutinating the dispersion particles, the particle size and shape of the toner can be controlled. The polymerized toner used here is expressed by use of a shape factor (SF) as follows.

$$100 \leqq SF \leqq 140$$

providing that the shape factor is expressed by the following expression.

$$SF = (ML^2\pi/4A) \times 100$$

(ML: maximum length of toner particle, A: area of projected image of toner particle)

Further in detail, the polymerized toner is set so that the shape factor of the polymerized toner is in a range of +/−2 around the center value 130.

The shape factor SF is obtained as follows. That is, an optical microscopic image of toner sprayed onto a slide glass is picked up into a Luzex image analyzer through a video camera, and calculation is made upon 50 or more pieces of toner so as to obtain a number average value.

In addition, when a magnetic brush contact type two-component development system is adopted for the developing units 41, 42, 43 and 44, and a cleanerless system is adopted as will be described later, there is a fear that foreign matters such as toner, carriers or external additives of the toner adhering to the surfaces of the photoconductor drums 11, 12, 13 and 14 enter charging positions directly, and adhere to the surfaces of the charging rolls 21, 22, 23 and 24. At that time, when carriers each having an outer diameter of several tens of $\mu$m which is larger than the diameter of the toner adhere to the surfaces of the charging rolls 21, 22, 23 and 24, a charging failure occurs because the diameter of the carriers is larger than the Paschen minimum (=8 82 m) which is a minimum value causing Paschen discharge.

Next, the toner images of the respective colors of yellow (Y), magenta (M), cyan (C) and black (K) formed on the photoconductor drums 11, 12, 13 and 14 are electrostatically primary-transferred onto the first and second primary intermediate transfer drums 51 and 52. The toner images of the colors of yellow (Y) and magenta (M) formed on the photoconductor drums 11 and 12 are transferred onto the first primary intermediate transfer drum 51. The toner images of the colors of cyan (C) and black (K) formed on the photoconductor drums 13 and 14 are transferred onto the second primary intermediate transfer drum 52. Thus, a unicolor image transferred from the photoconductor drum 11 or 12, and a two-color image in which toner images of two colors transferred from both the photoconductor drums 11 and 12 have been put on top of each other, are formed on the first primary intermediate transfer drum 51. On the other hand, a unicolor image and a two-color image from the photoconductor drums 13 and 14 are formed likewise on the second primary intermediate transfer drum 52.

The surface potential required for electrostatically transferring toner images from the photoconductor drums 11, 12, 13 and 14 onto the first and second primary intermediate transfer drums 51 and 52 is approximately in a range of from +250 V to +500 V. This surface potential is set to an optimum value in accordance with the charging state of toner, the atmospheric temperature, or the humidity. The atmospheric temperature or the humidity can be known easily by detecting the resistance value of a member having a property that the resistance value varies in accordance with the atmospheric temperature or the humidity. As described above, when the charging quantity of the toner is in a range of from −20 $\mu$C/g to 35 $\mu$C/g, and under the environment of room temperature and normal humidity, it is desired that the surface potential of each of the first and second primary intermediate transfer drums 51 and 52 is about +380 V.

For example, each of the first and second primary intermediate transfer drums 51 and 52 used in this embodiment is formed to have an outer diameter of 42 mm, and the resistance value is set to about $10^8$ Ω. Each of the first and second primary intermediate transfer drums 51 and 52 is a cylindrical body of revolution, which is constituted by a single layer or a plurality of layers and the surface of which has flexibility or elasticity. Generally, a low-resistance elastic rubber layer (R=$10^2$–$10^3$ Ω) represented by conductive silicon rubber and having a thickness in a range of from about 0.1 mm to about 10 mm is provided on a metal pipe as a metal core made of Fe, Al or the like. Further, in the outermost surfaces of the first and second intermediate transfer drums 51 and 52, typically, fluoro-rubber in which fluoro-resin particulates have been dispersed is formed as high-releasable layers (R=$10^5$–$10^9$ Ω) 3–100 $\mu$m thick, and bonded by silane coupling agent based bonding agents (primers). Here, the resistance value and the surface releasability are important factors. There is no special limit in material so long as the material of the high-releasable layers has a resistance value of about R=$10^5$–$10^9$ Ω, and high releasability.

In such a manner, the unicolor or two-color toner images formed on the first and second primary intermediate transfer drums 51 and 52 are electrostatically secondary-transferred onto the secondary intermediate transfer drum 53. Thus, final toner images from unicolor images to a four-color image of yellow (Y), magenta (M), cyan (C) and black (K) are formed on the secondary intermediate transfer drum 53.

The surface potential required for electrostatically transferring toner images from the first and second primary intermediate transfer drums 51 and 52 onto the secondary intermediate transfer drum 53 is approximately in a range of from +600 V to +1,200 V. This surface potential is set to an optimum value in accordance with the charging state of toner, the atmospheric temperature, or the humidity, in the same manner as when toner images are transferred from the photoconductor drums 11, 12, 13 and 14 to the first and second primary intermediate transfer drums 51 and 52. Since a difference in potential between the first and second primary intermediate transfer drums 51 and 52 and the secondary intermediate transfer drum 53 is required for transfer, it is necessary to set the surface potential of the secondary intermediate transfer drum 53 to take a value in accordance with the surface potential of the first and second primary intermediate transfer drums 51 and 52. As described above, when the charging quantity of the toner is in a range of from −20 $\mu$C/g to 35 $\mu$C/g, under the environment of room temperature and normal humidity, and when the surface potential of the first and second primary intermediate transfer drums 51 and 52 is about +380 V, it is desired that the surface potential of the secondary intermediate transfer drum 53 is set to about +880 V, that is, the difference in potential between the first and second primary intermediate transfer drums 51 and 52 and the secondary intermediate transfer drum 53 is set to about +500 V.

For example, the secondary intermediate transfer drum 53 used in this embodiment is formed to have an outer diameter of 42 mm as large as that of each of the first and second primary intermediate transfer drums 51 and 52, and the resistance value is set to about $10^{11}$ Ω. In addition, the secondary intermediate transfer drum 53 is a cylindrical body of revolution, which is constituted by a single layer or a plurality of layers and the surface of which has flexibility or elasticity, in the same manner as the first and second primary intermediate transfer drums 51 and 52. Generally, a low-resistance elastic rubber layer (R=$10^2$–$10^3$ Ω) represented by conductive silicon rubber and having a thickness of about 0.1–10 mm is provided on a metal pipe as a metal core made of Fe, Al or the like. Further, in the outermost surface of the secondary intermediate transfer drum 53, typically, fluoro-rubber in which fluoro-resin particulates have been dispersed is formed as a high-releasable layer 3–100 $\mu$m thick, and bonded by a silane coupling agent based bonding agent (primer). Here, the resistance value of the secondary intermediate transfer drum 53 has to be set to be higher than that of each of the first and second primary intermediate transfer drums 51 and 52. If not so, the secondary intermediate transfer drum 53 would charge the first and second primary intermediate transfer drums 51 and 52 so as to make it difficult to control the surface potential of the first and second primary intermediate transfer drums 51 and 52. There is no special limit in material if the material satisfies such conditions.

Next, the final toner images from unicolor images to a four-color image formed on the secondary intermediate transfer drum 53 are tertiary-transferred to the paper P passing through the paper conveying path by the final transfer roll 60. This paper P passes through a paper conveying roll 90 through a not-shown paper feeding step, so as to be fed into a nip portion between the secondary intermediate transfer drum 53 and the final transfer roll 60. After this final transfer step, a final toner image formed on the paper is fixed by a fixing unit 70. Thus, a series of image forming processes are completed.

Figure 4:
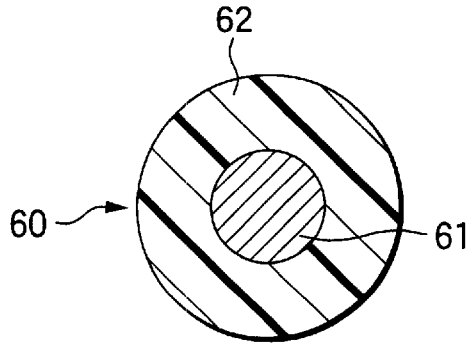
FIG. 4 is a sectional view showing a final transfer roll.

For example, the final transfer roll 60 is formed to have an outer diameter of 20 mm, and the resistance value is set to about $10^8$ Ω. The final transfer roll 60 is formed so that a coating layer 62 composed of urethane rubber or the like is provided on a metal shaft 61, and coating is given thereon in accordance with necessity, as shown in FIG. 4. The optimum value of a voltage applied to the final transfer roll 60 varies in accordance with the atmospheric temperature, the humidity, the kind of paper (resistance value or the like), and so on. The optimum value is generally approximately in a range of from +1,200 V to +5,000 V. In this embodiment, a constant current system is adopted, and a current of about +6 $\mu$A is applied under the environment of room temperature and normal humidity, so as to obtain a substantially appropriate transfer voltage (+1,600 to +2,000 V).

In such a series of transfer steps, a part of toner with positive polarity in a (−) charged image may become (+) charged toner with reverse polarity due to Paschen discharge or charge injection when the toner image passes through a transfer portion in any transfer step. Such (+) charged toner is not transferred to the next step but flows back to the upstream side. Thus, the (+) charged toner adheres to and is deposited on the charging devices 21, 22, 23 and 24 that are the highest in negative potential. Discharge is activated in such portions of the charging devices 21, 22, 23 and 24 to which the toner has adhered, so that the surface potential of the photoconductor drums 11, 12, 13 and 14 has a tendency to increase. Thus, in the surface potential of the photoconductor drums 11, 12, 13 and 14, unevenness appears among the portion to which a large amount of toner has adhered, the portion to which a small amount of toner has adhered, and the portion to which no toner has adhered. When there appears unevenness in the surface potential of the photoconductor drum 11, 12, 13 and 14, unevenness occurs in the latent image potential even if uniform exposure for forming an electrostatic latent image is applied to the image on the photoconductor drum 11, 12, 13 and 14. As a result, there is produced a difference in the quantity of development. Thus, particularly when a halftone image is developed, density unevenness becomes conspicuous.

In addition, the tandem type full-color printer is arranged as a so-called cleanerless image forming apparatus. That is, cleaning units for removing foreign matters adhering to the surfaces of the photoconductor drums 11, 12, 13 and 14 are not provided on the upstream side of the charging rolls 21, 22, 23 and 24. Accordingly, a system for removing foreign matters such as toner adhering to the surfaces of the photoconductor drums 11, 12, 13 and 14, other than the cleaning units, is adopted in this tandem type full-color printer, as will described next. However, if the system is adopted directly, it maybe difficult to remove toner or the like firmly adhering to the surfaces of the photoconductor drums 11, 12, 13 and 14.

Therefore, in the tandem type full-color printer according to this embodiment, as shown in FIG. 3, scraping members 91, 92, 93, 94, 95, 96 and 97 called refresher rolls and each constituted by a brush or the like driven to rotate are provided. The scraping members 91, 92, 93, 94, 95, 96 and 97 scrape foreign matters such as toner adhering to the surfaces of the photoconductor drums 11, 12, 13 and 14 and foreign matters such as toner adhering to the surfaces of the first and second primary intermediate transfer drums 51 and 52 and the secondary intermediate transfer drum 53, so as to effectively operate the removal system other than the cleaning units.

Thus, in this embodiment, in order to prevent such density unevenness caused by toner adhering to the charging devices 21, 22, 23 and 24, the following cleaning operation is carried out at predetermined timing such as before printing operation, after printing operation, or whenever the number of continuously printed sheets reaches a predetermined number.

Voltages with a potential gradient are applied sequentially to the charging devices 21, 22, 23 and 24, the photoconductor drums 11, 12, 13 and 14, the first and second primary intermediate transfer drums 51 and 52, the secondary intermediate transfer drum 53 and the final transfer roll 60 so that the final transfer roll 60 has the highest negative potential. Thus, (+) charged toner with reverse polarity adhering to and deposited on the charging devices 21, 22, 23 and 24 during the printing operation is transferred and moved, in turn, up to the final transfer roll 60. Then, the toner is recovered by the cleaning unit 80 including a final cleaning member 801 such as a blade provided in contact with the final transfer roll 60.

In this embodiment, the surface potential of the charging devices 21, 22, 23 and 24 is set to 0 V, the surface potential of the photoconductor drums 11, 12, 13 and 14 is set to −300 V, the surface potential of the first and second primary intermediate transfer drums 51 and 52 is set to −800 V, the surface potential of the secondary intermediate transfer drum 53 is set to −1,300 V, and the surface potential of the final transfer roll 60 is set to −2,000 V. This potential gradient is obtained by a system in which voltages are fed to metal portions (shafts or pipes) of the respective members. For example, if possible, there may be adopted a method in which the first and second primary intermediate transfer drums 51 and 52, the secondary primary intermediate transfer drum 53, and so on, are electrically floated so that desired surface potentials can be obtained by the relationship among the resistance values of these members. By such a negative voltage application cleaning mode, that is, a mode for recovery of (+) charged toner with reverse polarity, it is possible to prevent density unevenness caused by toner adhering to the charging devices 21, 22, 23 and 24.

Further, if necessary, toner charged with normal (−) polarity and left behind on the surfaces of the photoconductor drums 11, 12, 13 and 14, the first and second primary intermediate transfer drums 51 and 52 and the secondary intermediate transfer drum 53 can be removed in a similar manner (only by reversing the polarities of the applied voltages).

Figure 5:
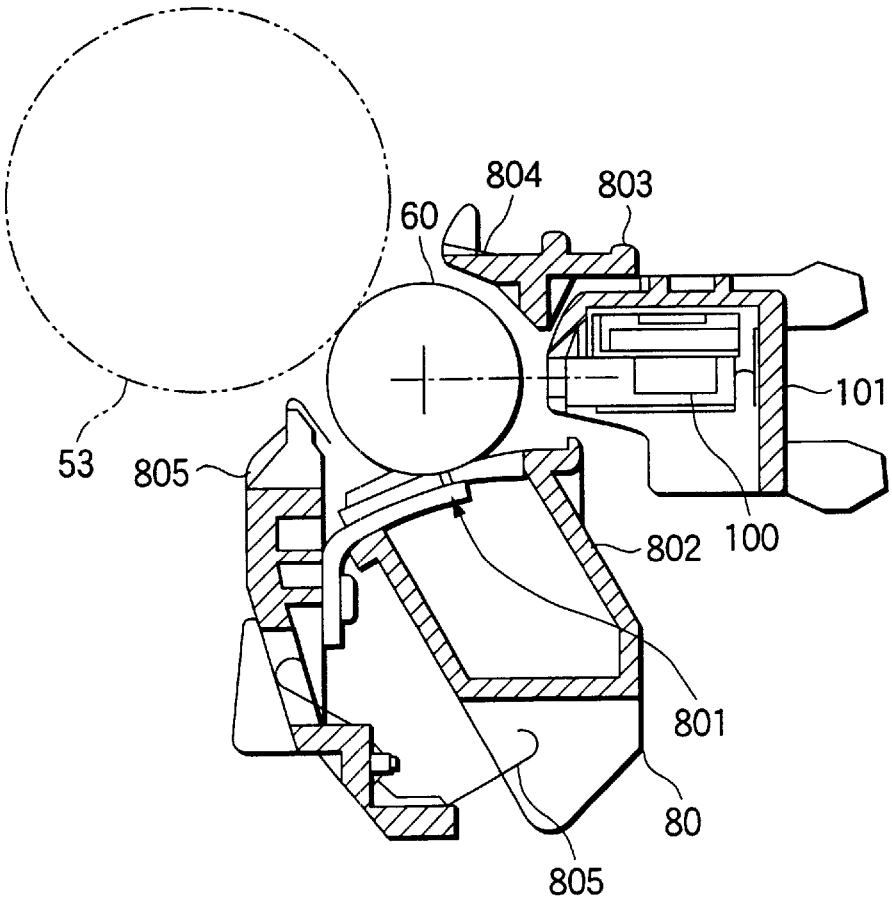
FIG. 5 is a sectional view showing a cleaning unit for the final transfer roll.

The cleaning unit 80 has a blade-like final cleaning member 801 for cleaning the surface of the final transfer roll 60 as shown in FIG. 5. In addition, in the outer circumference of the final transfer roll 60, an optical density sensor

100 for detecting a pattern for controlling the density with which toner is transferred onto the final transfer roll 60 or for correcting the color registration is fixedly attached into a holder 101 so as to be located on an prolongation of a radius of the final transfer roll 60. Incidentally, in FIG. 5, there are provided a toner recovery box 802, a support frame 803 of the final transfer roll 60, a destaticizer 804 provided on the support frame 803, and a bias plate 805.

The charging device according to the embodiment has a roll-like charging member disposed in contact with a surface of a member to be charged and for charging the surface of the member to be charged, in which the charging member has a conductive substrate, an elastic layer, and a surface layer, the elastic layer and the surface layer are applied sequentially onto a surface of the conductive substrate, opposite end portions of the surface layer axially project beyond opposite end portions of the elastic layer, respectively, and the opposite end portions of the surface layer cover the elastic layer and open.

Further, the charging device according to the embodiment has a roll-like charging member disposed in contact with a surface of a member to be charged and for charging the surface of the member to be charged, in which the charging member has a conductive substrate, an elastic layer, and a surface layer, the elastic layer and the surface layer are applied sequentially onto a surface of the conductive substrate, opposite end portions of the surface layer axially project beyond opposite end portions of the elastic layer, respectively, the opposite end portions of the surface layer cover the elastic layer and open, and a relationship among an outer diameter of the conductive substrate in a nip portion of the charging member, a thickness of the elastic layer and a thickness of the surface layer satisfies:

the outer diameter of the conductive substrate in the nip portion of the charging member>the thickness of the elastic layer+the thickness of the surface layer.

In addition, in this embodiment, the charging member has a ratio of a length of a charging portion to a diameter of the conductive substrate expressed by:

(length of charging portion)/(diameter of conductive substrate)≧40.

Further, in this embodiment, the surface layer is bonded to a surface of the elastic layer and an unbonded area is partially provided in the surface layer in an axial direction of the charging member.

In addition, the charging device according to this embodiment is designed so that a voltage applied to the charging member includes only a DC voltage.

Figure 1A:
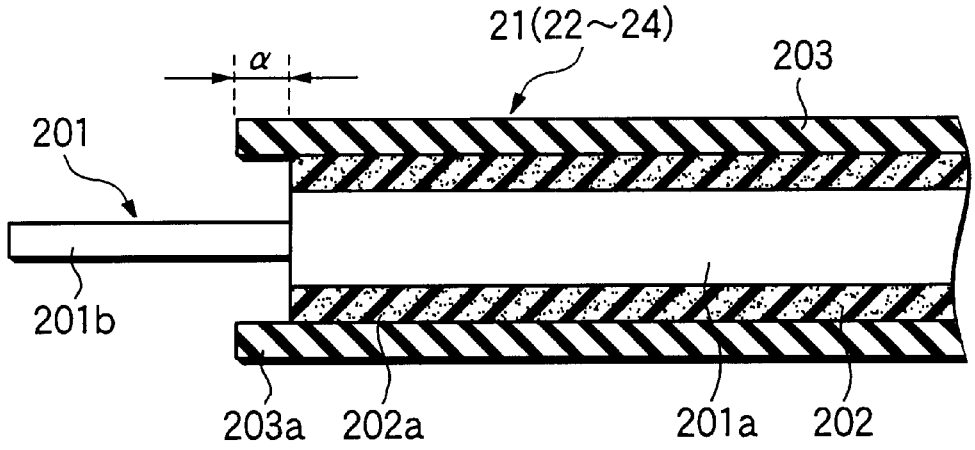
FIGS. 1A and 1B are a configuration sectional view and a main portion perspective view showing a charging device according to Embodiment 1 of the invention, respectively.
Figure 1B:
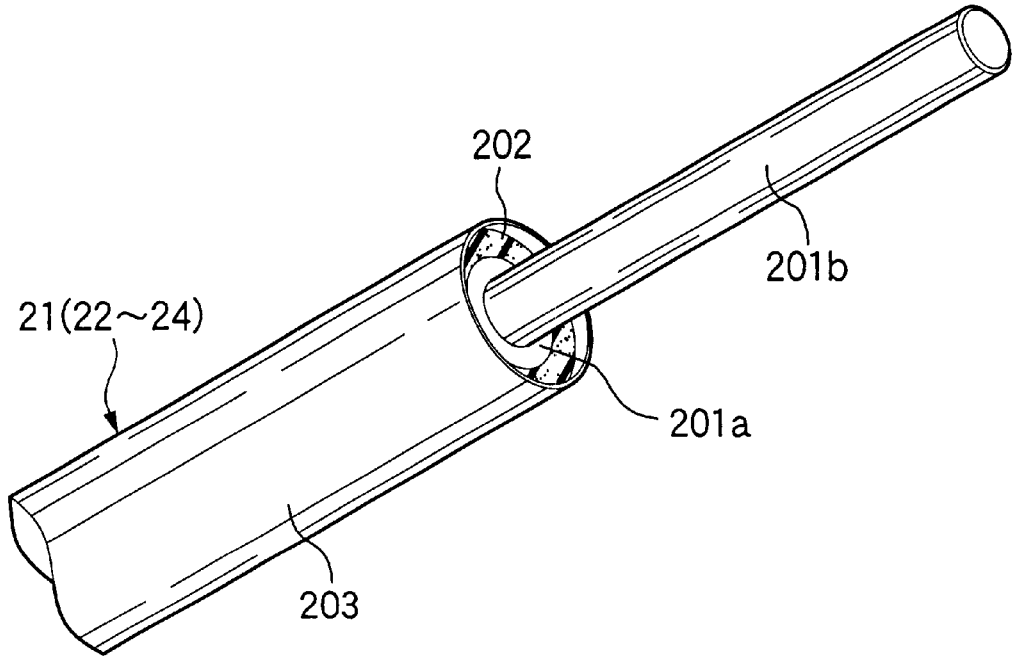

FIGS. 1A and 1B are configuration views showing the charging device according to this Embodiment 1. This charging device is, for example, used as the charging roll 21, 22, 23 and 24 in the tandem type full-color printer as described above.

The charging device has a charging roll 21, 22, 23 and 24 as a charging member, as shown in FIGS. 1A, 1B, 6 and 7. The charging roll 21, 22, 23 and 24 has a metal shaft 201 as a conductive substrate, an elastic layer 202 and a surface layer 203 applied sequentially onto the surface of the metal shaft 201. Further, a layer other than the elastic layer 202 and the surface layer 203, for example, a coat layer for coating the surface may be included in the layers applied sequentially onto the surface of the metal shaft 201.

The metal shaft 201 is made of metal such as stainless steel, iron or aluminum. The metal shaft 201 is constituted by a large diameter portion 201*a* having a large diameter, and a shaft portion 201*b* having a small diameter. The large diameter portion 201*a* forms almost all the contact portion of the charging roll 21, 22, 23 and 24 in contact with the surface of the photoconductor drum 11, 12, 13 and 14. The shaft portion 201*b* is provided integrally with the large diameter portion 201*a* so as to project beyond the opposite end portions of the large diameter portion 201*a*. The large diameter portion 201*a* of the metal shaft 201 is, for example, set to 5 mm in diameter, while the shaft portion 201*b* is, for example, set to 3 mm in diameter.

On the other hand, the elastic layer 202 is, for example, made of sponge-like urethane foam given conductivity. The volume resistance value of the elastic layer 202 is set to range from $10^2$ Ω·cm to $10^7$ Ω·cm, for example, at $10^3$ Ω·cm. After urethane is foamed, this urethane foam is dipped into coat liquid in which a conductive agent such as carbon black has been dispersed to adjust the resistance value. Thus, conductivity is given to the urethane foam as a whole. Further, the elastic layer 202 is set to 1.5 mm in thickness, and applied onto the outer circumference of the metal shaft 201*a*.

Further, the surface layer 203 is, for example, formed into a thin tubular member made of epichlorohydrin rubber (ECO), and the surface resistance value thereof is set to range from $10^6$ Ω/□ to $10^8$ Ω/□. The surface layer 203 is adjusted to have a predetermined surface resistance value by controlling the amount of a conductive agent such as carbon black dispersed into the epichlorohydrin rubber. In addition, the surface layer 203 is set to be 0.5 mm thick.

In such a manner, each of the charging rolls 21, 22, 23 and 24 is set so that the diameter of the large diameter portion 201*a* in the nip portion of the metal shaft 201 is 5 mm while the thickness of the elastic layer 202 and the thickness of the surface layer 203 are set to 1.5 mm and 0.5 mm respectively. Thus, setting is done so that the diameter (5 mm) of the large diameter portion 201*a* in the nip portion of the metal shaft 201 is larger than the sum (2.0 mm) of the thickness (1.5 mm) of the elastic layer 202 and the thickness (0.5 mm) of the surface layer 203. Further, in this embodiment, setting is done so that the diameter (5 mm) of the large diameter portion 201*a* in the nip portion of the metal shaft 201 is larger than the total sum (4.0 mm) of the thickness of the elastic layer 202 and the thickness of the surface layer 203. It is desired that the diameter (5 mm) of the large diameter portion 201*a* in the nip portion of the metal shaft 201 is thus larger than the total sum (4.0 mm) of the thickness of the elastic layer 202 and the thickness of the surface layer 203.

Each of the charging rolls 21, 22, 23 and 24 configured thus is set so that the surface Asker MD1 (microhardness) is not higher than 70°. In this embodiment, the Asker MD1 (microhardness) is set to 42°.

Further, in this embodiment, each of the first and second primary intermediate transfer drums 51 and 52 in contact with the surfaces of the photoconductor drums 11, 12, 13 and 14 is also set so that the surface Asker MD1 (microhardness) is not higher than 70°. In this case, it is desired that the surface Asker MD1 of each of the charging rolls 21, 22, 23 and 24 is set to be equal to or smaller than the surface Asker MD1 of each of the first and second primary intermediate transfer drums 51 and 52.

Incidentally, when a cleaning brush, a cleaning blade or the like brought in contact with each of the surfaces of the photoconductor drums 11, 12, 13 and 14 is provided, it is desired that the surface Asker MD1 (microhardness) of the cleaning brush, the cleaning blade or the like is set to be not higher than 70°.

Further, each of the charging rolls 21, 22, 23 and 24 is formed to be about 8 mm in outer diameter (diameter) while the charging portion of each of the charging rolls 21, 22, 23 and 24 determined by the length of the elastic layer 202 is set to be 210 mm long corresponding to A4 size paper. As a result, each of the charging rolls 21, 22, 23 and 24 is designed as a very small diameter roll in which the ratio of the length of the charging portion to the diameter of the metal shaft functioning as a conductive substrate satisfies (length of charging portion)/(diameter of conductive substrate)=210/5=42≧40. On the other hand, a related-art charging roll is set so that the outer diameter is in a range of from 12 mm to 14 mm and the diameter of the conductive substrate is about 8 mm. Thus, the ratio of the length of the charging portion to the diameter of the metal shaft as a conductive substrate is expressed by (length of charging portion)/(diameter of conductive substrate)=210/8=26.25<40.

The surface layer 203 is arranged as shown in FIGS. 1A and 1B. That is, each of opposite end portions 203*a* of the surface layer 203 axially projects beyond corresponding one of opposite end portions 202*a* of the elastic layer 202 by a predetermined distance α (about 2 mm). In addition, each of the opposite end portions 203*a* of the surface layer 203 is formed into a cylindrical shape opened while covering the elastic layer 202. In such a manner, the projecting distance α of the surface layer 203 is set to be longer than the thickness of the surface layer 203.

Further, the surface layer 203 is formed into a thin tubular member as described above. The surface layer 203 formed into a thin tubular member is applied to the surface of the elastic layer 202 and bonded with the surface of the elastic layer 202 through a conductive bonding agent. At that time, the surface layer 203 is not bonded to the whole length of the elastic layer 202. As shown in FIG. 9, an unbonded area having a predetermined width (for example, about 3 cm) is left in each of the opposite end portions of the elastic layer 202 while the other area becomes a bonded area. Incidentally, the bonded area between the surface layer 203 and the elastic layer 202 does not have to be in the center portion. As shown in FIG. 10, a plurality of bonded areas may be set to be on the opposite end sides or to be divided axially.

For example, the charging roll configured thus is provided as follows. That is, the elastic layer 202 is applied to the outer circumference of the large diameter portion 201*a* of the metal shaft 201 so as to have a predetermined thickness. After that, the surface of the elastic layer 202 is coated, from one end portion side of the charging roll, with the surface layer 203 formed into a thin tubular member. At that time, a conductive bonding agent is applied to the surface of the elastic layer 202 in advance, so that the elastic layer 202 and the surface layer 203 are bonded over the predetermined bonded area.

The charging rolls 21, 22, 23 and 24 configured thus are attached in a constant displacement system so that the quantity of biting the surface of each of the photoconductor drums 11, 12, 13 and 14 takes a predetermined value (for example, 0.3 mm) to thereby form a predetermined nip width (for example, 1.0 mm) between the charging rolls 21, 22, 23 and 24 and the corresponding photoconductor drums 11, 12, 13 and 14.

Figure 8:
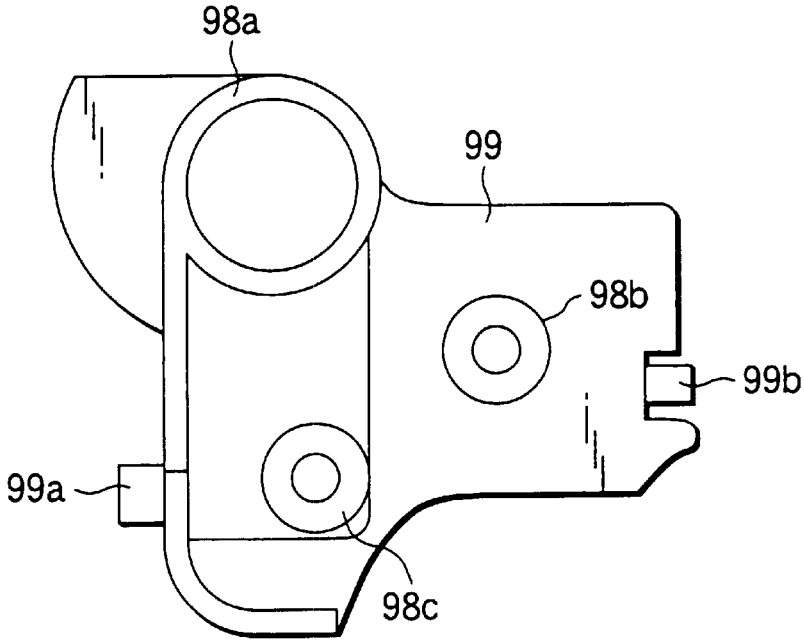
FIG. 8 is a configuration view showing a constant displacement contact system of the charging roll.

That is, as shown in FIG. 8, the opposite end portions of the charging roll 21 together with the photoconductor drum 11 and refresher roll 91 are rotatably attached to a bracket 99 through bearings 98*a*, 98*b* and 98*c*. The bracket 99 is attached by fixing claw members 99*a* and 99*b* while being fitted to a not-shown housing body of the printer. Then, the bearings 98*a*, 98*b* and 98*c* for the shaft of the photoconductor drum 11, the shaft 201 of the charging roll 21 and the shaft of the refresher roll 91 are provided integrally with the bracket 99. Thus, each of the displacements of the charging rolls 21, 22, 23 and 24 with respect to the surfaces of the photoconductor drums 11, 12, 13 and 14 takes a predetermined value in accordance with the distances among the bearings 98*a*, 98*b* and 98*c*.

Figure 6:
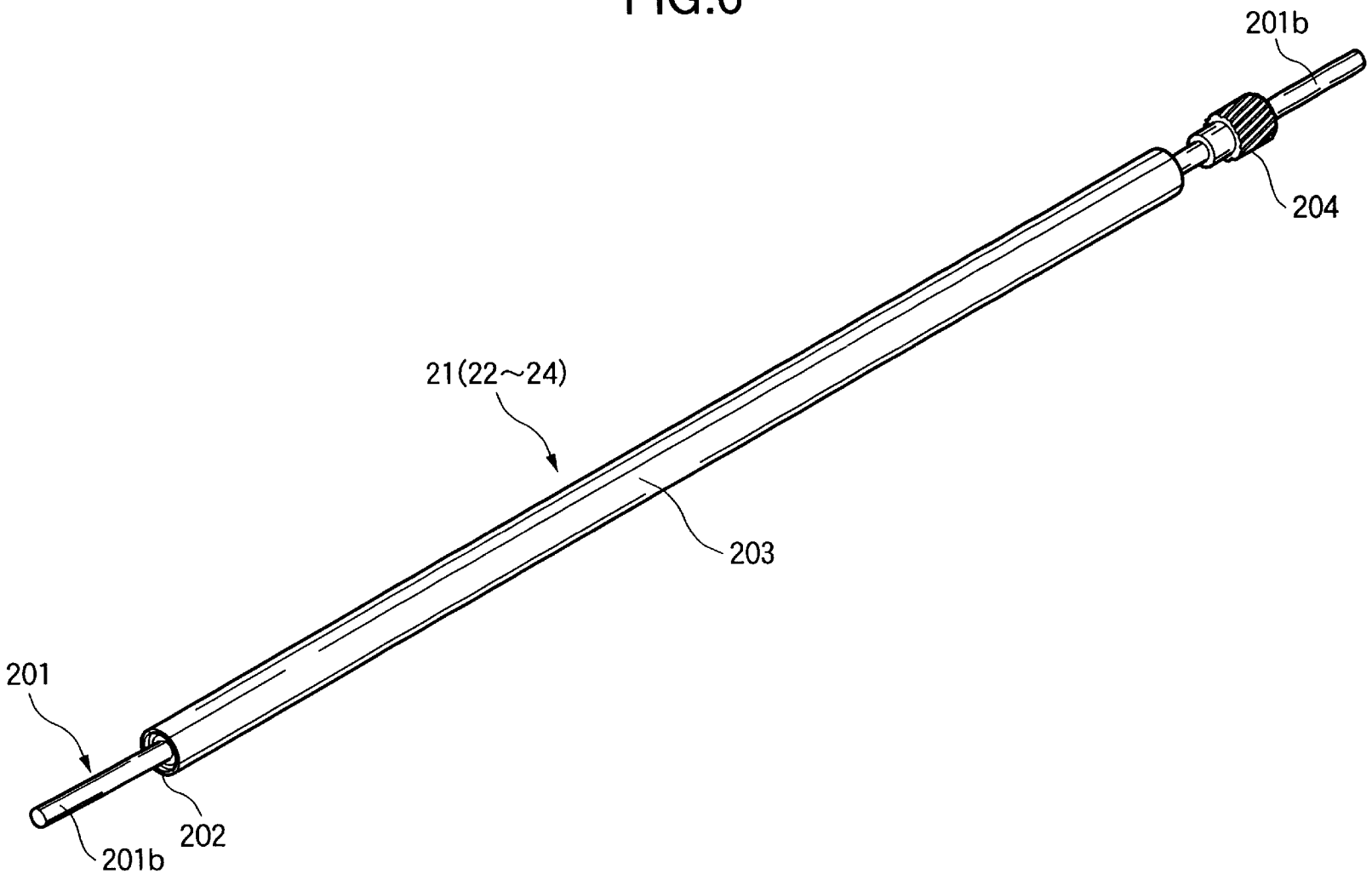
FIG. 6 is an outline perspective view of a charging roll of the charging device according to Embodiment 1 of the invention.
Figure 7:
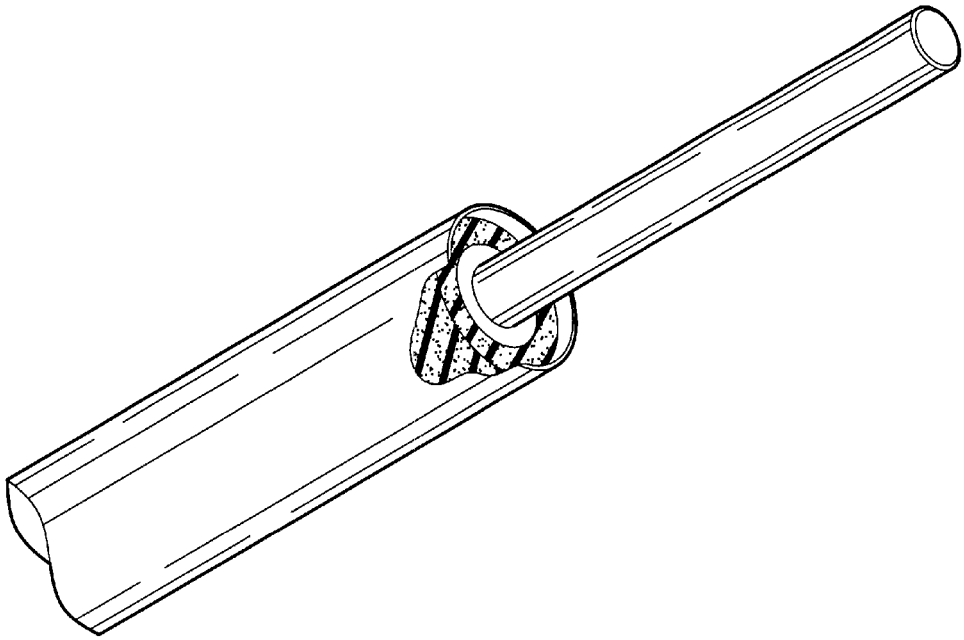
FIG. 7 is a partially broken main portion perspective view showing the charging roll of the charging device according to Embodiment 1 of the invention.

In addition, as shown in FIG. 6, a rotation driving gear 204 attached to one end portion of the shaft portion 201*b* of the metal shaft 201 of each of the charging rolls 21, 22, 23 and 24 is engaged with a not-shown gear or the like provided in an end portion of corresponding one of the photoconductor drums 11, 12, 13 and 14. Thus, the charging rolls 21, 22, 23 and 24 are driven to rotate at a peripheral velocity equal to the peripheral velocity of the photoconductor drums 11, 12, 13 and 14.

In order to prevent foreign matters such as toner from adhering to the surfaces of the charging rolls 21, 22, 23 and 24, however, the charging rolls 21, 22, 23 and 24 maybe designed to be driven to rotate at a peripheral velocity higher by about 2–3% than the peripheral velocity of the photoconductor drums 11, 12, 13 and 14.

In this embodiment, in each of the charging rolls 21, 22, 23 and 24, the relationship among the outer diameter of the conductive substrate in the nip portion of the charging member, the thickness of the elastic layer and the thickness of the surface layer satisfies:

outer diameter of conductive substrate in nip portion of charging member>thickness of elastic layer+thickness of surface layer.

Each of the charging rolls 21, 22, 23 and 24 configured thus may be integrated with at least corresponding one of the photoconductor drums 11, 12, 13 and 14 so as to form a unit which can be removably attached to the image forming apparatus body. In this case, such units can be made smaller in size and lighter in weight because the charging rolls 21, 22, 23 and 24 have small diameters.

In this configuration, even if the charging rolls are made smaller in diameter, leakage from the opposite portions of the charging rolls in the image forming apparatus to which the charging devices according to Embodiment 1 are applied can be prevented with a simple structure as follows. In addition, the charging rolls are superior in uniformity of charging.

That is, this full-color printer is designed as follows. As shown in FIGS. 1A, 1B, 2 and 3, when an image is formed, a predetermined DC voltage, for example, a DC voltage of about −900 V is applied to the charging rolls 21, 22, 23 and 24 brought in contact with the surfaces of the photoconductor drums 11, 12, 13 and 14 of the respective image forming units 1, 2, 3 and 4 through the metal shafts 201 of the charging rolls 21, 22, 23 and 24. As a result, the surfaces of the photoconductor drums 11, 12, 13 and 14 are charged, for example, to about −300 V by discharge generated in very small gaps formed between the charging rolls 21, 22, 23 and 24 and the surfaces of the photoconductor drums 11, 12, 13 and 14. The very small gap is in the vicinity of the nip portion.

On the other hand, the charging rolls 21, 22, 23 and 24 are designed as follows. That is, as shown in FIGS. 1A and 1B, in each of the charging rolls 21, 22, 23 and 24, the opposite end portions 203*a* of the surface layer 203 axially project beyond the opposite end portions 202*a* of the elastic layer 202 respectively. In addition, each of the opposite end portions 203*a* of the surface layer 203 is formed into a cylindrical shape opened while covering the elastic layer 202.

Figure 18:
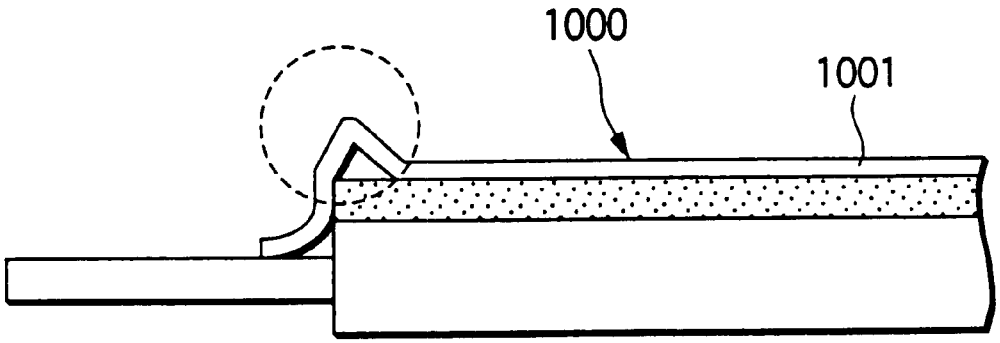
FIG.18 (PRIOR ART)
FIG. 18 is an explanatory view showing a related-art charging roll.
Figure 19:
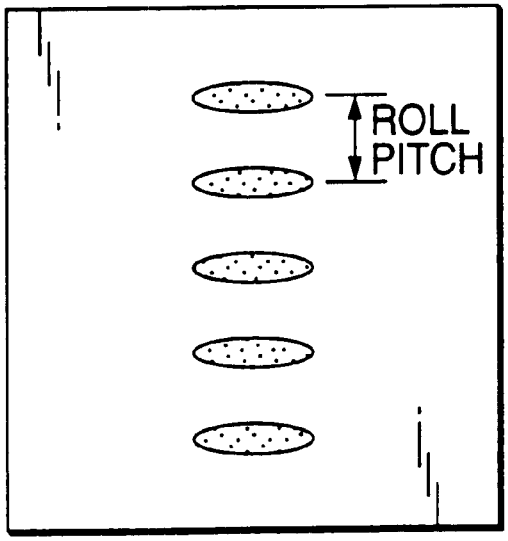
FIG.19 (PRIOR ART)
FIG. 19 is an explanatory view showing a defect of image quality in the related-art charging roll.

In the related-art charging roll which is coated, from one end surface to the other end surface, with a surface layer, the surface layer projects beyond the end portions of the charging roll as shown in FIG. 18. Thus, there appears a failure in the outer shape, uneven contact between the charging roll and the photoconductor drum surface, or a change of the outer shape due to an environmental change, such as depression of the surface layer due to the shrinkage of the air confined in the surface layer in the end portions of the charging roll at the time of low temperature. In comparison with the related art, in this embodiment, there is no fear of such a failure, such an uneven contact and such a change. In addition, because the charging roll does not have to be coated, from one end surface to the other end surface, with the surface layer, it is possible to prevent the processing cost from increasing.

In addition, as shown in FIGS. 1A and 1B, each of the charging rolls 21, 22, 23 and 24 is formed so that each of the opposite end portions 203*a* of the surface layer 203 is longer than corresponding one of the opposite end portions 202*a* of the elastic layer 202 by a predetermined distance a so as to protrude axially beyond the corresponding opposite end portion 202*a*. Thus, the projecting opposite end portions 203*a* of the surface layer 203 become higher in resistance than that in the power supply side that applies a predetermined DC voltage to the charging roll. It is therefore possible to prevent leakage from the opposite portions surely with a simple structure. Further, as the diameters of the charging rolls 21, 22, 23 and 24 are made smaller, the distance between the metal shaft and the photoconductor drum surface becomes shorter so that leakage is apt to appear. However, since the resistance in the end portions of the charging rolls can be increased as described above, it is possible to prevent the occurrence of leakage from the end portions surely even if the diameters of the charging rolls are made small. Further, when surface treatment is given to the surfaces of the charging rolls 21, 22, 23 and 24 or coat layers are applied thereto respectively, it is possible to put treatment liquid up to the inside from the opening portions in the opposite end portions 203*a* of the surface layer 203. Thus, since the resistance in the end portions is increased by the treatment liquid, there is also an advantage that the antileak property is further enhanced.

In addition, in each of the charging rolls 21, 22, 23, and 24, unbonded areas may be provided in the axially opposite end portions as shown in FIG. 9 when the surface layer 203 is bonded to the outer circumference of the elastic layer 202. In this case, even if the outer shape of the tubular member constituting the surface layer 203 is somewhat poor in accuracy, the variation in the outer dimensions can be absorbed by the flexibility formed between the surface layer 203 and the elastic layer 202 in the unbonded areas. As a result, it is possible to nip the surface layer 203 and the elastic layer 202 uniformly all over the area. In addition, when a conductive bonding agent sticks out from the opposite portions of the elastic layer 202, there is a fear that leakage occurs. However, by providing the unbonded areas in the opposite end portions of the elastic layer 202, it is possible to prevent leakage from occurring.

Thus, in this embodiment, even if the charging rolls are made smaller in diameter, leakage from the opposite portions can be prevented with a simple structure. In addition, the charging rolls are superior in uniformity of charging.

Experimental Example

The present inventor et al. manufactured a printer as shown in FIGS. 2 and 3 by way of trial, and made an experiment for examining the grade of spots caused by a failure of charging, the grade of filming due to the adhesion of external additives or the like of toner to the surfaces of charging rolls, and the grade of deletion which occurred an image flow under a high humidity environment due to the adhesion of external additives or the like of toner to the surfaces of conductor drums, when the Asker MD1 (microhardness) of the charging roll surfaces was varied.

FIG. 11 shows the result of the experiment.

In FIG. 11, as for the grade of spots, the respective symbols xx, x, o and oo designate the following cases respectively. That is, the symbol xx designates the case where the number of sheets with spots was not smaller than 21 when 100 sheets of A4 size paper were printed under a low temperature and low humidity environment. The symbol x designates the case where the number of sheets with spots was not larger than 20 and not smaller than 11 when 100 sheets of A4 size paper were printed under a low temperature and low humidity environment. The symbol o designates the case where the number of sheets with spots was not larger than 10 and not smaller than 2 when 100 sheets of A4 size paper were printed under a low temperature and low humidity environment. The symbol oo designates the case where the number of sheets with spots was not larger than 1 when 100 sheets of A4 size paper were printed under a low temperature and low humidity environment.

In addition, as for the grade of filming, the respective symbols xx, x, o and oo designate the following cases respectively. That is, the symbol xx designates the case where there occurred a white or black stripe in 20% half tone when at most 3,000 sheets of A4 size paper were printed under a low temperature and low humidity environment. The symbol x designates the case where there occurred a white or black stripe in 20% half tone when at most 5,000 sheets of A4 size paper were printed under a low temperature and low humidity environment. The symbol o designates the case where there occurred a white or black stripe in 20% half tone when at most 10,000 sheets of A4 size paper were printed under a low temperature and low humidity environment. The symbol oo designates the case where there occurred a white or black stripe in 20% half tone when at least 10,000 sheets of A4 size paper were printed under a low temperature and low humidity environment.

Further, as for the grade of deletion, the respective symbols x, o and oo designate the following cases respectively. That is, the symbol x designates the case where there occurred a white stripe in a print of 20% half tone under a high temperature and high humidity environment after 3,000 sheets of A4 size paper were printed under a low temperature and low humidity environment. The symbol o designates the case where there occurred no white stripe in a print of 20% half tone under a high temperature and high humidity environment after 3,000 sheets of A4 size paper were printed under a low temperature and low humidity environment. The symbol oo designates the case where there occurred no white stripe in at least 1,000 sheets of prints of 20% half tone under a high temperature and high humidity environment after 3,000 sheets of A4 size paper were printed under a low temperature and low humidity environment.

As a result, as is apparent from FIG. 11, it is proved that all the grades of spots, filming and deletion were good when the Asker MD1 (microhardness) of the charging roll surfaces was set to be not higher than 70 degrees.

Figure 12:
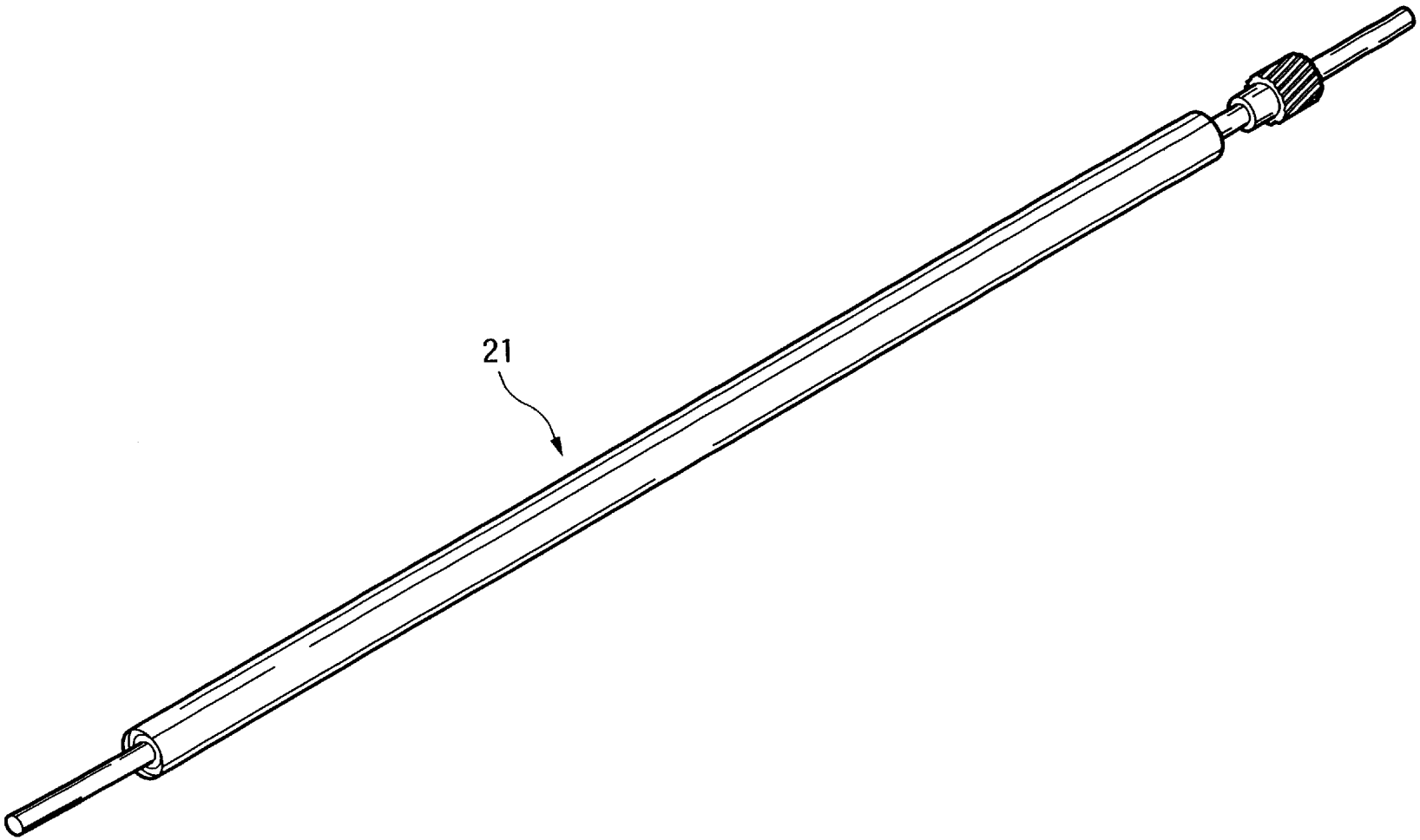
FIG. 12 is an outline perspective view showing another example of the charging roll of the charging device according to Embodiment 1 of the invention.
Figure 13:
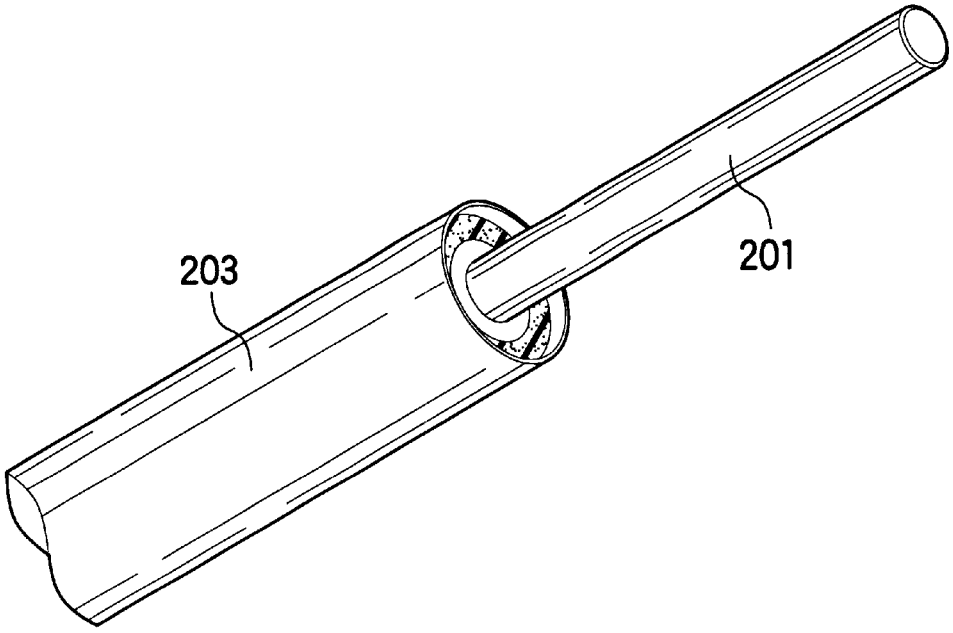
FIG. 13 is a main portion perspective view showing another example of the charging roll of the charging device according to Embodiment 1 of the invention.
Figure 14:
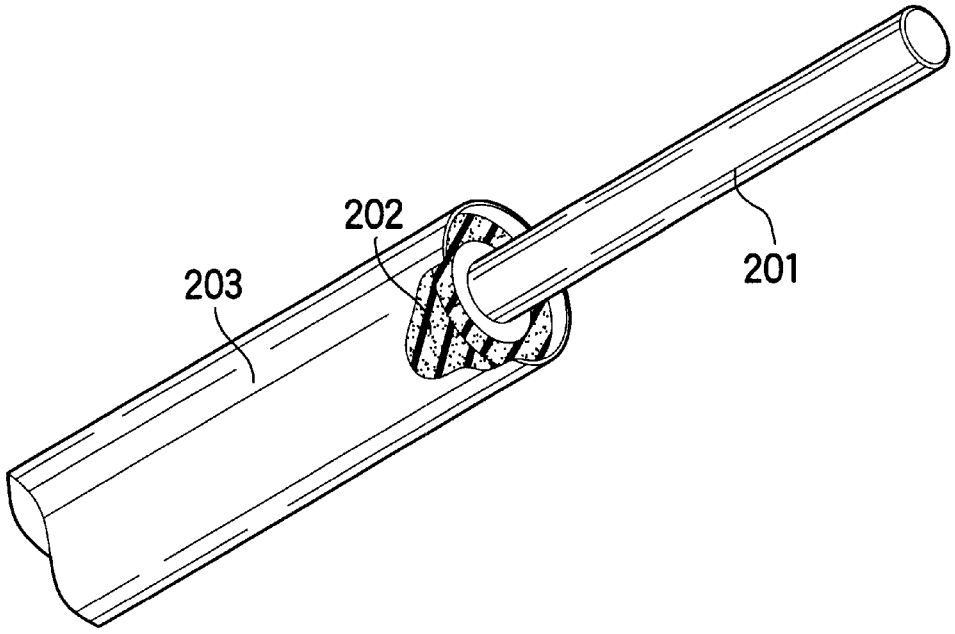
FIG. 14 is a partially broken main portion perspective view showing the charging roll of the charging device according to Embodiment 1 of the invention.

Incidentally, FIGS. 12 to 14 show the charging roll 21, 22, 23 and 24 in which the surface layer 203 is formed to be very thin out of a tubular member made of PVdf or the like with a thickness of 0.05 mm.

Embodiment 2

FIGS. 15 to 17 show Embodiment 2 of the invention. Description will be made while parts the same as those in Embodiment 1 are referenced correspondingly. Charging members according to Embodiment 2 are designed so that the ionization potential of the surfaces thereof is set to be not lower than 4.8.

That is, a tandem type full-color printer according to Embodiment 2 is configured as a so-called cleanerless image forming apparatus in the same manner as that in Embodiment 1. That is, cleaning units for removing foreign matters adhering to the surfaces of the photoconductor drums 11, 12, 13 and 14 are not provided on the upstream sides of the charging rolls 21, 22, 23 and 24. Accordingly, a system for removing foreign matters such as toner adhering to the surfaces of the photoconductor drums 11, 12, 13 and 14, other than the cleaning units, is adopted in this tandem type full-color printer, as will described next. However, if the system is adopted directly, it maybe difficult to remove toner or the like firmly adhering to the surfaces of the photoconductor drums 11, 12, 13 and 14.

Therefore, in the tandem type full-color printer according to this embodiment, as shown in FIG. 3, scraping members 91, 92, 93, 94, 95, 96 and 97 called refresher rolls and each constituted by a brush or the like driven to rotate are provided. The scraping members 91, 92, 93, 94, 95, 96 and 97 scrape foreign matters such as toner adhering to the surfaces of the photoconductor drums 11, 12, 13 and 14 or foreign matters such as toner adhering to the surfaces of the first and second primary intermediate transfer drums 51 and 52 and the secondary intermediate transfer drum 53, so as to effectively operate the removal system other than the cleaning units.

Thus, in this embodiment, in order to prevent such density unevenness caused by toner adhering to the charging devices 21, 22, 23 and 24, the following cleaning operation without using the cleaning units is carried out at predetermined timing such as before printing operation, after printing operation, or whenever the number of continuously printed sheets reaches a predetermined number.

Voltages with a potential gradient are applied sequentially to the charging devices 21, 22, 23 and 24, the photoconductor drums 11, 12, 13 and 14, the first and second primary intermediate transfer drums 51 and 52, the secondary intermediate transfer drum 53 and the final transfer roll 60 so that the final transfer roll 60 has the highest negative potential. Thus, (+) charged toner with reverse polarity adhering to and deposited on the charging devices 21, 22, 23 and 24 during the printing operation is transferred and moved, in turn, up to the final transfer roll 60. Then, the toner is recovered by the cleaning unit 80 including a final cleaning member 801 such as a blade provided in contact with the final transfer roll 60.

In this embodiment, the surface potential of the charging devices 21, 22, 23 and 24 is set to 0 V, the surface potential of the photoconductor drums 11, 12, 13 and 14 is set to −300 V, the surface potential of the first and second primary intermediate transfer drums 51 and 52 is set to −800 V, the surface potential of the secondary intermediate transfer drum 53 is set to −1,300 V, and the surface potential of the final transfer roll 60 is set to −2,000 V. This potential gradient is obtained by a system in which voltages are fed to metal portions (shafts or pipes) of the respective members. For example, if possible, there may be adopted a method in which the first and second primary intermediate transfer drums 51 and 52, the secondary primary intermediate transfer drum 53, and so on, are electrically floated so that desired surface potentials can be obtained by the relationship among the resistance values of these members. By such a negative voltage application cleaning mode, that is, a mode for recovery of (+) charged toner with reverse polarity, it is possible to prevent density unevenness caused by toner adhering to the charging devices 21, 22, 23 and 24.

Further, if necessary, toner charged with normal (−) polarity and left behind on the surfaces of the photoconductor drums 11, 12, 13 and 14, the first and second primary intermediate transfer drums 51 and 52 and the secondary intermediate transfer drum 53 can be removed in a similar manner (only by reversing the polarities of the applied voltages).

Further, in Embodiment 2, the ionization potential in the surfaces of the charging rolls 21, 22, 23 and 24 is set to be not lower than 4.8. Thus, in the cleaning cycle, there is provided a predetermined potential difference between the surface potential of the charging rolls 21, 22, 23 and 24 and the surface potential of the photoconductor drums 11, 12, 13 and 14. As a result, when toner with normal charge polarity or toner with reverse charge polarity adhering to the surfaces of the charging rolls 21, 22, 23 and 24 is removed electrostatically, the toner with normal charge polarity or the toner with reverse charge polarity can be removed efficiently so that a failure of image quality can be reduced to be small enough to be negligible.

The surface layer 203 in each of the charging rolls 21, 22, 23 and 24 is set so that the ionization potential in the surface thereof is not lower than 4.8 eV. Not to say, a material whose ionization potential is 4.8 eV or higher may be used as the material forming the surface layer 203. Alternatively, surface treatment may be given to the surface of the surface layer 203 or a coat layer may be provided on the surface of the surface layer 203 so that the ionization potential in the surface of the surface layer 203 becomes 4.8 eV or higher.

As the material for forming the surface layer 203, for example, ETFE (ethylene-tetrafluoroethylene copolymer) whose ionization potential is 4.83 eV may be used. Alternatively, as the material for forming the surface layer 203, for example, epichlorohydrin rubber (ECO) whose ionization potential is 4.49 eV may be used. In this case, surface treatment referred to as SC is given to the surface layer 203 made of the epichlorohydrin rubber (ECO) so as to make the ionization potential become 4.8 eV. Here, the SC treatment in FIG. 15 means a treatment in which heating is carried out in an oven at 120° C. for about 1 hour after dipping in treatment liquid made of isocyanate (NCO) (15 parts by weight), fluororesin (2 parts by weight) and a solvent (83 parts by weight) at 23° C. for about 30 seconds. For example, MR-400 made by Nippon Polyurethane Industry Co., Ltd., V-FLON #200 made by Dai Nippon Toryo Co., Ltd. and ethyl acetate are used as the isocyanate, the fluororesin and the solvent respectively.

In addition, PVdF designates polyvinylidene fluoride, and PVdF+E designates PVdF added with elastomer to thereby obtain a resin softened.

Further, ECO+PHT designates epichlorohydrin rubber whose surface has been coated with a PHT film. As the PHT, there was used PHT (made by SGT Ltd.) which was an acrylic surface coat material. Incidentally, air drying was carried out for about 15 minutes after the surface coating.

Further, 96SP in ECO+96SP designates a silicon-based surface coat material. KF-96SP (made by Shin-Etsu Silicones) was used. Air drying was carried out for about 5 minutes after aerosol was sprayed.

Incidentally, the inventor et al. have found that the ionization potential in the surfaces of the charging rolls 21, 22, 23 and 24 affected the toner removal performance when toner adhering to the surfaces of the charging rolls 21, 22, 23 and 24 was removed by voltages with a potential gradient applied to the charging rolls 21, 22, 23 and 24, the photoconductor drums 11, 12, 13 and 14, and so on, as described previously.

Therefore, the inventor et al. manufactured charging rolls 21, 22, 23 and 24 as shown in FIG. 15 by way of trial. Each of the charging rolls 21, 22, 23 and 24 was different in ionization potential in accordance with the material for forming the surface material 203, or in accordance with surface treatment or surface coating. Then, the inventor et al. made an experiment for examining the amount of toner adhering to the surfaces of the charging rolls 21, 22, 23 and 24, the amount of residual toner when a cleaning cycle was carried out, the initial image quality and the stained image quality. Incidentally, the specific gravity of toner used was 1.2.

FIGS. 16 and 17 show the result of the experiment. The printer as shown in FIGS. 2 and 3 was used.

FIG. 16 shows the relationship between the amount of toner ($g/m^2$) adhering to the surfaces of the charging rolls 21, 22, 23 and 24 and the printed image quality.

As is apparent from FIG. 16, it is proved that there is a tendency that the image quality deteriorates in accordance with the increase in stains on the surfaces of the charging rolls 21, 22, 23 and 24. To obtain Grade 1 which is a level with no problem in image quality, it is important to make the quantity of stains on the surfaces of the charging rolls 21, 22, 23 and 24 not larger than 0.25 ($g/m^2$).

Here, in FIG. 16, the abscissa designates the amount of toner adhering to the surfaces of the charging rolls 21, 22, 23 and 24, and the ordinate designates the image quality in which Grade "0" designates a good case. Incidentally, Grades for the image quality designate 0: not defective at all, 1: very slightly defective, 2: slightly defective, 3: acceptably defective, 4: unseemly defective, 5: very unseemly defective, and 6: out of the question. The permissible level is set to Grade 2, and grades not greater than Grade 2 are regarded as passed. Further, the evaluation of the image quality was carried out with reference to "Evaluation of Images in Copying Machines" Optics, Vol. 12, No. 4 (August 1983), pp.267–277.

FIG. 17 shows the relationship between the IP value in the surfaces of the charging rolls 21, 22, 23 and 24 and the amount of toner (amount of residual toner after cleaning) ($g/m^2$) left behind on the surfaces of the charging rolls 21, 22, 23 and 24 after a cleaning cycle. Incidentally, the ionization potential (IP) value in the surfaces of the charging rolls 21, 22, 23 and 24 was measured by a photoelectron spectrometer AC-1 (made by Riken Keiki Co., Ltd.).

From the result of FIG. 16, it is important that the IP value in the surfaces of the charging rolls 21, 22, 23 and 24 is not lower than 4.8 eV because the amount of residual toner on the surfaces of the charging rolls 21, 22, 23 and 24 has to be not larger than 0.25 ($g/m^2$).

FIG. 16 is a graph using the stains on the surfaces of the charging rolls and the grade of image quality in the table of FIG. 15. It is proved from FIG. 16 that the grade of image quality takes an allowable value when the quantity of stains on the surfaces of the charging rolls is not larger than 0.25 $g/m^2$. In addition, it was proved that when the grade of initial image quality was Grade 1 or Grade 2, toner which had adhered to the surfaces of the charging rolls in the first print caused the deterioration of the image quality. Thus, it was proved that the cleaning cycle had to be carried out for every print in order to keep good image quality. Further, it was found that when a material having an ionization potential (IP) value of less than 4.8, such as PVdF softened by addition of elastomer was used, the ionization potential (IP) value had little change, but the amount of residual toner after cleaning was affected. On the other hand, when a material having an ionization potential (IP) value of 4.8 or more, such as the material of ECO+SC, was used, there was no change in the amount of residual toner after cleaning even if the surface conditions (Asker MD1 hardness from 40° to 70° and surface roughness Rz from 4 $\mu$m to 12 $\mu$m) were changed by changing the treatment method. Thus, it was found that it was important that the ionization potential (IP) value was not lower than 4.8.

Here, in FIG. 17, the abscissa designates the IP value in the surfaces of the charging rolls 21, 22, 23 and 24, and the ordinate designates the amount of residual toner after cleaning.

The other configuration and operation are similar to those in Embodiment 1, and description thereof will be omitted.

Although description in the embodiments was made on the case where the surface of a member to be charged is charged by charging members. The charging members may be arranged to be used for transfer or destaticization.

As described above, according the invention, there is provided a charging device which can prevent leakage from its end portions with a simple structure even if the diameter of a charging roll is made smaller, and which is superior in uniformity of charging, and to provide an image forming apparatus using the charging device.

Further, according to the second aspect of the invention, a charging member includes a conductive substrate, and at least an elastic layer and a surface layer applied sequentially onto a surface of the conductive substrate, opposite end portions of the surface layer axially project beyond opposite end portions of the elastic layer respectively, while the opposite end portions of the surface layer are made to cover the elastic layer and made open, and a relationship among an outer diameter of the conductive substrate in a nip portion of the charging member, a thickness of the elastic layer and a thickness of the surface layer satisfies:

outer diameter of conductive substrate in nip portion of charging member>thickness of elastic layer+thickness of surface layer.

Accordingly, the charging roll can be made smaller in diameter. At the same time, with the conductive substrate made smaller in diameter, the charging roll can be made lighter in weight.

What is claimed is:

1. A charging device comprising:

a roll-like charging member disposed in contact with a surface of a member to be charged and for charging the surface of the member to be charged, wherein the charging member comprises:

a conductive substrate;

an elastic layer; and a surface layer, wherein the elastic layer and the surface layer are applied sequentially onto a surface of the conductive substrate;

wherein opposite end portions of the surface layer axially project beyond opposite end portions of the elastic layer, respectively;

wherein the opposite end portions of the surface layer cover the elastic layer and open;

wherein the elastic layer has an inner circumference, the conductive substrate has an outer circumference, and the entire inner circumference of the elastic layer contacts the entire outer circumference of the conductive substrate; and wherein a relationship among an outer diameter of the conductive substrate in a nip portion of the charging member, a thickness of the elastic layer and a thickness of the surface layer satisfies:

the outer diameter of the conductive substrate in the nip portion of the charging member>the thickness of the elastic layer+the thickness of the surface layer.

2. The charging device according to claim 1, wherein each of projecting portions of the end portions of the surface layer is longer than the thickness of the surface layer.

3. The charging device according to claim 1, wherein the charging member has a higher resistance value in its opposite ends than that in a power feeding portion.

4. The charging device according to claim 1, wherein the conductive substrate is set to have a larger outer diameter in a nip portion thereof than in any other portion thereof.

5. The charging device according to claim 1, wherein the charging member is set to have a diameter not larger than 10 mm.

6. The charging device according to claim 1, wherein the surface layer is formed to be longer than the elastic layer.

7. The charging device according to claim 1, wherein the charging member has a ratio of a length of a charging portion to a diameter of the conductive substrate expressed by:

(length of charging portion)/(diameter of conductive substrate)≧40.

8. The charging device according to claim 1, wherein the surface layer is bonded to a surface of the elastic layer; and wherein an unbonded area is partially provided in the surface layer in an axial direction of the charging member.

9. The charging device according to claim 8, wherein the unbonded area is provided in opposite end portions of the surface layer in the axial direction of the charging member.

10. The charging device according to claim 8, wherein the surface layer is bonded to a surface of the elastic layer, wherein an unbonded area is partially provided in the surface layer along an axial direction of the charging member, and wherein in the unbonded area, the surface layer is not bonded to the elastic layer but covers the elastic layer.

11. The charging device according to claim 8, wherein the surface layer is bonded to a surface of the elastic layer by a bonding agent.

12. The charging device according to claim 1, wherein a voltage applied to the charging member includes only a DC voltage.

13. The charging device according to claim 1, wherein the charging member has a peripheral velocity difference from that of the member to be charged.

14. The charging device according to claim 1, wherein the charging member does not have, on an upstream side thereof, any cleaning unit for removing foreign matters adhering to a surface of the member to be charged.

15. The charging device according to claim 1, wherein the upstream side of the charging member is one of a transfer unit and a pseudo cleaning unit for temporarily retaining residual toner which failed in transfer.

16. The charging device according to claim 1, wherein the surface layer is made of a thin tubular member.

17. The charging device according to claim 1, wherein the elastic layer is made of urethane foam.

18. The charging device according to claim 1, wherein the charging member is used for one of transfer and elimination of charge.

19. A charging device comprising:

a roll-like charging member disposed in contact with a surface of a member to be charged and for charging the surface of the member to be charged, wherein the charging member comprises:

a conductive substrate;

an elastic layer; and a surface layer, wherein the elastic layer and the surface layer are applied sequentially onto a surface of the conductive substrate;

wherein opposite end portions of the surface layer axially project beyond opposite end portions of the elastic layer, respectively;

wherein the opposite end portions of the surface layer cover the elastic layer and open; and wherein the charging member is set so that Asker MD1 hardness of a surface of the charging member is not higher than 70°.

20. A charging device comprising:

a roll-like charging member disposed in contact with a surface of a member to be charged and for charging the surface of the member to be charged, wherein the charging member comprises:

a conductive substrate;

an elastic layer; and a surface layer, wherein the elastic layer and the surface layer are applied sequentially onto a surface of the conductive substrate;

wherein opposite end portions of the surface layer axially project beyond opposite end portions of the elastic layer, respectively;

wherein the opposite end portions of the surface layer cover the elastic layer and open; and wherein the charging member is set so that ionization potential of a surface of the charging member is not lower than 4.8 eV.

21. An image forming apparatus comprising:

an image carrying body; and a roll-like charging member brought in contact with a surface of the image carrying body, the charging member for charging the surface of the image carrying body to form a toner image on the image carrying body, wherein any cleaning unit for removing foreign matters adhering to a surface of a member to be charged is not provided on an upstream side of the charging member;

wherein the charging member comprises:

a conductive substrate;

an elastic layer; and a surface layer, wherein the elastic layer and the surface layer are applied sequentially onto a surface of the conductive substrate;

wherein opposite end portions of the surface layer axially project beyond opposite end portions of the elastic layer, respectively;

wherein the opposite end portions of the surface layer cover the elastic layer and open;

wherein the elastic layer has an inner circumference, the conductive substrate has an outer circumference, and the entire inner circumference of the elastic layer contacts the entire outer circumference of the conductive substrate; and wherein a relationship among an outer diameter of the conductive substrate in a nip portion of the charging member, a thickness of the elastic layer and a thickness of the surface layer satisfies:

the outer diameter of the conductive substrate in the nip portion of the charging member>the thickness of the elastic layer+the thickness of the surface layer. unit; and wherein the unit is removably attached to a body of the image forming apparatus.

22. The image forming apparatus according to claim 21, wherein at least the charging member and the image carrying body are integrated into one unit; and wherein the unit is removably attached to a body of image forming apparatus.

23. An image forming apparatus comprising:

an image carrying body; and a roll-like charging member brought in contact with a surface of the image carrying body, the charging member for charging the surface of the image carrying body to form a toner image on the image carrying body, wherein one of a transfer unit and a pseudo cleaning unit for temporarily retaining residual toner which failed in transfer is disposed in an upstream side of the charging member;

wherein the charging member comprises:

a conductive substrate;

an elastic layer; and a surface layer, wherein the elastic layer and the surface layer are applied sequentially onto a surface of the conductive substrate;

wherein opposite end portions of the surface layer axially project beyond opposite end portions of the elastic layer, respectively;

wherein the opposite end portions of the surface layer cover the elastic layer and open;

wherein the elastic layer has an inner circumference, the conductive substrate has an outer circumference, and the entire inner circumference of the elastic layer contacts the entire outer circumference of the conductive substrate; and wherein a relationship among an outer diameter of the conductive substrate in a nip portion of the charging member, a thickness of the elastic layer and a thickness of the surface layer satisfies:

the outer diameter of the conductive substrate in the nip portion of the charging member>the thickness of the elastic layer+the thickness of the surface layer.

24. The image forming apparatus according to claim 23, wherein at least the charging member and the image carrying body are integrated into one unit; and wherein the unit is removably attached to a body of the image forming apparatus.

25. A charging device comprising:

a roll-like charging member disposed in contact with a surface of a member to be charged and for charging the surface of the member to be charged, wherein the charging member comprises:

a conductive substrate;

an elastic layer; and a surface layer, wherein the elastic layer and the surface layer are applied sequentially onto a surface of the conductive substrate;

wherein opposite end portions of the surface layer axially project beyond opposite end portions of the elastic layer, respectively;

wherein the opposite end portions of the surface layer cover the elastic layer and open;

wherein the surface layer is bonded to a surface of the elastic layer by a conductive bonding agent;

wherein an unbonded area is partially provided along the surface layer in an axial direction of the charging member; and wherein in the unbonded area, the surface layer is not bonded to the elastic layer but covers the elastic layer.

* * * * *